US010458645B2

(12) United States Patent
Matsumoto et al.

(10) Patent No.: US 10,458,645 B2
(45) Date of Patent: Oct. 29, 2019

(54) COMBUSTION BURNER AND BOILER PROVIDED WITH SAME

(71) Applicant: MITSUBISHI HITACHI POWER SYSTEMS, LTD., Yokohama-shi, Kanagawa (JP)

(72) Inventors: Keigo Matsumoto, Tokyo (JP); Yukihiro Tominaga, Tokyo (JP); Akimasa Takayama, Tokyo (JP); Kazuhiro Domoto, Yokohama (JP); Ryuichiro Tanaka, Yokohama (JP); Keita Tsukahara, Yokohama (JP); Naofumi Abe, Yokohama (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 67 days.

(21) Appl. No.: 15/553,273

(22) PCT Filed: Feb. 22, 2016

(86) PCT No.: PCT/JP2016/055008
§ 371 (c)(1),
(2) Date: Aug. 24, 2017

(87) PCT Pub. No.: WO2016/158081
PCT Pub. Date: Oct. 6, 2016

(65) Prior Publication Data

US 2018/0045403 A1 Feb. 15, 2018

(30) Foreign Application Priority Data

Mar. 31, 2015 (JP) ..... 2015-073498
Sep. 11, 2015 (JP) ..... 2015-179762

(51) Int. Cl.
*F23C 5/08* (2006.01)
*F23D 1/00* (2006.01)
(Continued)

(52) U.S. Cl.
CPC ..... *F23C 5/08* (2013.01); *F23C 99/00* (2013.01); *F23D 1/00* (2013.01); *F23D 1/04* (2013.01); *F23D 2201/20* (2013.01)

(58) Field of Classification Search
CPC ..... F23C 99/00; F23C 5/08; F23D 1/00
(Continued)

(56) References Cited

U.S. PATENT DOCUMENTS 766,494 A 8/1904 Crone
1,103,253 A 7/1914 Bennett
(Continued)

FOREIGN PATENT DOCUMENTS

CN 2281479 Y 5/1998
CN 2415254 Y 1/2001
(Continued)

OTHER PUBLICATIONS

International Search Report dated Apr. 19, 2016, issued in International Application No. PCT/JP2016/054978, with English translation (4 pages).
(Continued)

*Primary Examiner* — Gregory L Huson
*Assistant Examiner* — Nikhil P Mashruwala
(74) *Attorney, Agent, or Firm* — Westerman, Hattori, Daniels & Adrian, LLP

(57) ABSTRACT

To provide: a fuel nozzle (51) that can inject fuel gas in which fuel and air are mixed; a flame stabilizer (54) provided on an axial center side near a tip end of the fuel nozzle (51); and a casing member (55) that partitions an inner flow channel in which the flame stabilizer (54) is provided and an outer flow channel on an outer side of the inner flow channel, inside the fuel nozzle (51), where the flow channel cross-
(Continued)

sectional area of the inner flow channel partitioned by the casing member (55) expands in the flow direction of the fuel gas.

13 Claims, 13 Drawing Sheets

(51) Int. Cl.
*F23D 1/04* (2006.01)
*F23C 99/00* (2006.01)

(58) Field of Classification Search
USPC ..... 431/5, 12; 110/188
See application file for complete search history.

(56) References Cited

U.S. PATENT DOCUMENTS

| | | | | |
|---|---|---|---|---|
| 1,887,330 | A | 11/1932 | Shaw | |
| 2,149,980 | A | 3/1939 | Paret, Jr. | |
| 2,259,010 | A | 10/1941 | Taylor | |
| 2,360,548 | A | 10/1944 | Conway | |
| 2,895,435 | A * | 7/1959 | Bogot | F23D 1/00 239/424 |
| 3,112,988 | A | 12/1963 | Colden | |
| 3,209,811 | A | 10/1965 | Strang | |
| 3,213,919 | A | 10/1965 | Calzolari | |
| 3,823,875 | A | 7/1974 | Bauer et al. | |
| 4,284,402 | A | 8/1981 | Sheets et al. | |
| 4,520,739 | A | 6/1985 | McCartney et al. | |
| 4,634,054 | A | 1/1987 | Grusha | |
| 5,215,259 | A | 6/1993 | Wark | |
| 5,231,937 | A * | 8/1993 | Kobayashi | C04B 7/44 110/262 |
| 5,292,246 | A | 3/1994 | Gateau et al. | |
| 5,483,906 | A * | 1/1996 | Hufton | F23D 1/00 110/260 |
| 5,529,000 | A | 6/1996 | Hartel et al. | |
| 5,782,626 | A | 7/1998 | Joos et al. | |
| 6,003,793 | A | 12/1999 | Mann | |
| 6,089,171 | A | 7/2000 | Fong et al. | |
| 6,158,223 | A | 12/2000 | Mandai et al. | |
| 6,334,770 | B1 | 1/2002 | Giraud et al. | |
| 6,461,145 | B1 | 10/2002 | Giraud et al. | |
| 6,579,085 | B1 | 6/2003 | Satchell, Jr. et al. | |
| 7,163,392 | B2 | 1/2007 | Feese et al. | |
| 7,500,849 | B2 | 3/2009 | Dudill et al. | |
| 8,070,484 | B2 | 12/2011 | Just et al. | |
| 8,105,075 | B2 | 1/2012 | Huau | |
| 8,393,892 | B2 | 3/2013 | Hagihara et al. | |
| 9,546,784 | B2 * | 1/2017 | Van Der Ploeg | C10J 3/506 |
| 9,671,108 | B2 * | 6/2017 | Matsumoto | F23C 5/32 |
| 2008/0206696 | A1 | 8/2008 | Wark | |
| 2008/0268387 | A1 | 10/2008 | Saito et al. | |
| 2009/0214989 | A1 | 8/2009 | Swanson et al. | |
| 2009/0220899 | A1 | 9/2009 | Spangelo et al. | |
| 2009/0277364 | A1 | 11/2009 | Donais et al. | |
| 2010/0044282 | A1 | 2/2010 | Zarnescu et al. | |
| 2010/0064986 | A1 | 3/2010 | Kiyama et al. | |
| 2012/0171629 | A1 | 7/2012 | Kang et al. | |
| 2012/0247376 | A1 | 10/2012 | Matsumoto et al. | |
| 2013/0291770 | A1 | 11/2013 | Kashima et al. | |
| 2014/0011141 | A1 | 1/2014 | Matsumoto et al. | |
| 2014/0227647 | A1 | 8/2014 | Mueller-Hagedorn et al. | |
| 2015/0068438 | A1 * | 3/2015 | Taniguchi | F23C 6/045 110/346 |
| 2016/0010853 | A1 | 1/2016 | Matsumoto et al. | |
| 2016/0356489 | A1 | 12/2016 | Matsumoto et al. | |
| 2016/0356490 | A1 | 12/2016 | Matsumoto et al. | |
| 2016/0356494 | A1 | 12/2016 | Matsumoto et al. | |
| 2017/0045221 | A1 * | 2/2017 | Matsumoto | F23C 5/32 |

FOREIGN PATENT DOCUMENTS

| | | | |
|---|---|---|---|
| CN | 1 407 274 | A | 4/2003 |
| CN | 201302156 | Y | 9/2009 |
| CN | 102620291 | A | 8/2012 |
| CN | 202938290 | U | 5/2013 |
| CN | 103267282 | A | 8/2013 |
| CN | 103443543 | A | 12/2013 |
| CN | 103672883 | A | 3/2014 |
| CN | 203718765 | U | 7/2014 |
| EP | 0035153 | A1 | 9/1981 |
| EP | 0 129 001 | A1 | 12/1984 |
| EP | 2 267 365 | A2 | 12/2010 |
| EP | 2 518 404 | A1 | 10/2012 |
| EP | 2659186 | A2 | 11/2013 |
| EP | 2 696 139 | A1 | 2/2014 |
| JP | S59-009414 | A | 1/1984 |
| JP | S59-077206 | A | 5/1984 |
| JP | 59-205510 | A | 11/1984 |
| JP | S60-103207 | A | 6/1985 |
| JP | 1-217109 | A | 8/1989 |
| JP | 4-024404 | A | 1/1992 |
| JP | 8-135919 | A | 5/1996 |
| JP | 9-203505 | A | 8/1997 |
| JP | 11-072230 | A | 3/1999 |
| JP | 11-281010 | A | 10/1999 |
| JP | 2009-204256 | A | 9/2009 |
| JP | 2010-270992 | A | 12/2010 |
| JP | 2011-149676 | A | 8/2011 |
| JP | 2012-122653 | A | 6/2012 |
| JP | 2012-215362 | A | 11/2012 |
| JP | 2012-215363 | A | 11/2012 |
| JP | 2015-52450 | A | 3/2015 |
| WO | 2008/038426 | A1 | 4/2008 |
| WO | 2012/098848 | A1 | 7/2012 |
| WO | 2012/137573 | A1 | 10/2012 |

OTHER PUBLICATIONS

Written Opinion dated Apr. 19, 2016, issued in International Application No. PCT/JP2016/054978, with English translation (10 pages).
Extended Search Report dated Jun. 20, 2018, issued in European Application No. 16844082.4 (10 pages).
Extended Search Report dated Jun. 22, 2018, issued in European Application No. 16771963.2 (7 pages).
International Search Report dated Sep. 20, 2016, issued in International Application No. PCT/JP2016/072564 (5 pages).
Office Action dated Jun. 5, 2018, issued in Japanese Application No. 2017-509377, with English translation (13 pages).
Office Action dated Jun. 5, 2018, issued in counterpart Japanese Application No. 2017-509379, with English translation (11 pages).
Written Opinion dated Sep. 20, 2016, issued in International Application No. PCT/JP2016/072564 (10 pages).
Extended Search Report dated Feb. 12, 2018, issued in counterpart European Application No. 16771965.7 (7 pages).
International Search Report dated Apr. 19, 2016, issued in counterpart International Application No. PCT/JP2016/055008, with English translation (5 pages).
Extended Search Report dated Feb. 12, 2016, issued in counterpart European Application No. 16771965.7 (7 pages).
Written Opinion dated Apr. 19, 2016, issued in counterpart Application No. PCT/JP2016/055008, with English Translation. (7 pages).
Office Action dated Aug. 2, 2018. issued in counterpart Chinese Application No. 201680011710.1, with English translation (12 pages).
Office Action dated Sep. 20, 2018, issued in counterpart Korean Application No. 10-2017-7021755, with English translation (13 pages).
Office Action dated Dec. 18, 2018, issued in KR Application No. 10-2017-7036865, (counterpart to U.S. Appl. No. 15/736,108; with English translation (12 pages).
Office Action dated Mar. 13, 2019, issued in counterpart CN application No. 201680011710.1, with English translation. (11 pages).

(56) References Cited

OTHER PUBLICATIONS

Non-Final Office Action dated Mar. 21, 2019, issued in U.S. Appl. No. 15/553,307 (31 pages).
Office Action dated Jun. 3, 2019, issued in CN Application No. 201680037949.6, with English translation (10 pages).
Office Action dated Aug. 2, 2019, issued in counterpart IN application No. 201747027882, with English translation. (6 pages).

* cited by examiner

COMBUSTION BURNER AND BOILER PROVIDED WITH SAME

TECHNICAL FIELD

The present invention relates to: a combustion burner applied to a boiler for generating steam for power generation, factory use, or the like; and a boiler provided with same.

Background Art

For example, a conventional pulverized coal burning boiler has a furnace installed in a vertical direction forming a hollow shape, and a plurality of combustion burners are provided on a wall of the furnace along a circumferential direction and provided across a plurality of levels in a vertical direction. The combustion burner supplies a mixture of primary air (air) and powdered coal (fuel) formed by pulverizing coal, and supplies high temperature combustion burner air (coal secondary air), and the mixture and combustion burner air are injected into the furnace to form a flame such that combustion is possible in the furnace. Furthermore, a flue is connected to an upper portion of the furnace, a heat exchanger such as a superheater, reheater, economizer, or the like for recovering heat of exhaust gas is provided in the flue, and heat exchanging is performed between the water and exhaust gas generated by combustion in the furnace, and thus steam can be produced.

An example of a combustion burner of the pulverized coal burning boiler is described in the following Patent Document 1. Patent Document 1 describes a combustion burner providing: a fuel nozzle spraying fuel gas in which solid fuel and primary air are mixed; a combustion burner air nozzle that sprays combustion burner air from an outer circumference of a fuel nozzle; and a flame stabilizer provided in an opening portion of the fuel nozzle. The flame stabilizer of the combustion burner described in Patent Document 1 has a structure essentially intersecting the opening portion of the fuel nozzle, and has a split shape that branches the fuel gas in a flow direction of the fuel gas; the fuel nozzle and combustion burner air nozzle have a structure that sprays the fuel gas and combustion burner air in a straight flow; and a plurality of flame stabilizers are intersectingly connected and are provided positioned with an intersecting portion at a center region of the opening portion of the fuel nozzle.

CITATION LIST

Patent Document

Patent Document 1: Japanese Unexamined Patent Application Publication No. 2011-149676A

SUMMARY OF INVENTION

Technical Problems

The combustion burner provides a flame stabilizer inside the fuel nozzle as with the device described in Patent Document 1, and therefore, internal ignition of the fuel gas where solid fuel and air are mixed can be implemented, and the amount of NOx generation can be reduced. However, the combustion burner described in Patent Document 1 ignites combustion gas and combustion burner air (so-called external ignition) to form a high-temperature and high-oxygen region, and therefore, a problem occurs where a large amount of NOx is generated.

Furthermore, even if the flame stabilizer is provided inside the fuel nozzle as in Patent Document 1, solid fuel such as pulverized coal has a slower combustion rate than gas fuel, flame blow-off and the like may occur, and thus stabilized ignition in the flame stabilizer is relatively difficult. Therefore, stable ignition is preferably achieved by reducing the flow rate of fuel gas to approach the combustion rate.

In view of the foregoing, an object of the present invention is to provide: a combustion burner that can achieve stable ignition by reducing the flow rate of fuel gas in which fuel and air are mixed near the combustion rate to reduce the amount of NOx generation; and a boiler provided with the burner.

Solution to Problem

A combustion burner according to one aspect of the present invention for achieving the aforementioned object is a combustion burner, including: a fuel nozzle that can inject fuel gas in which fuel and air are mixed; at least one flame stabilizer provided on an axial center side near a tip end of the fuel nozzle; and a partitioning member that partitions an inner flow channel in which the flame stabilizer is provided and an outer flow channel on an outer side of the inner flow channel, inside the fuel nozzle, wherein the flow channel cross-sectional area of the inner flow channel partitioned by the partitioning member expands in the flow direction of the fuel gas.

The partitioning member that partitions the inner flow channel in which the flame stabilizer is provided and the outer flow channel on an outer side of the inner flow channel is provided in the fuel nozzle, and the flow channel cross-sectional area of the inner flow channel expands in the flow direction of the fuel gas due to the partitioning member, and therefore, the flow rate of the fuel gas in the inner flow channel can be reduced. Thereby, flame blow-off is suppressed by making the flow rate of the fuel gas to approach the combustion rate, and therefore, a more stable flame is possible. Therefore, internal flame stabilizing where a flame is internally stabilized on a central axis side of the combustion burner is enhanced, thereby, a high-temperature and high-oxygen region which can occur on an outer circumferential side of the fuel nozzle can be suppressed, and thus NOx can be reduced.

Furthermore, in the combustion burner according to one aspect of the present invention, the partitioning member is a casing member.

The inner flow channel and outer flow channel are partitioned by the casing member. The cross-sectional shape orthogonal to the flow of fuel gas of the casing member is arbitrary, but a polygonal shape such as a tetragon or the like, or a circular shape, elliptical shape, or oval shape may be used.

Furthermore, in the combustion burner according to one aspect of the present invention, the partitioning member has two plate-shaped bodies that extend mutually, providing an interval with the flame stabilizer interposed therebetween, and the plate-shaped bodies are connected to a wall surface demarcating an outer circumference of the fuel nozzle.

The partitioning member has two plate-shaped bodies, and the plate-shaped bodies are connected to a wall surface demarcating an outer circumference of the fuel nozzle.

Thereby, an inner flow channel surrounded by a wall surface of the fuel nozzle and two plate-shaped bodies is formed.

The combustion burner according to one aspect of the present invention includes a combustion burner air nozzle supplying air from the outside of the fuel nozzle, wherein the flow channel cross-sectional area of the outer flow channel partitioned by the partitioning member decreases in the flow direction of the fuel gas.

The flow channel cross-sectional area of the outer flow channel positioned on an outer side of the partitioning member is reduced in the flow direction of the fuel gas, and therefore, the flow rate of the fuel gas flowing through the outer flow channel is increased. Thereby, the difference in flow rate between air supplied from the combustion burner air nozzle and fuel gas flowing through the outer flow channel can be reduced, and ignition and mixing of the air supplied from the combustion burner air nozzle and fuel gas flowing through the outer flow channel is suppressed, and thus formation of a high-temperature and high-oxygen region can be avoided as much as possible.

Note that the outer flow channel typically refers to a flow channel between the partitioning member and inner wall portion of the fuel nozzle (in some cases, an inner wall portion of the combustion burner air nozzle acts as an inner wall portion of the fuel nozzle).

Furthermore, in the combustion burner according one aspect of the present invention, the partitioning member has an inclination angle, which is an angle to a direction parallel to a flow direction of the fuel gas, that decreases with regard to an upstream end portion in the flow direction of the fuel gas, when approaching a tip end side.

An inclination angle, which is an angle to a direction parallel to a flow direction of the fuel gas, decreases with regard to an upstream end portion in the flow direction of the fuel gas, when approaching a tip end side, and therefore, peeling of the fuel gas flowing through the inner flow channel can be suppressed, and the flow rate of the fuel gas can be effectively reduced.

Furthermore, in the combustion burner according to one aspect of the present invention, a guide surface inclined toward an axial center side of the fuel nozzle is provided on an inner wall surface of the partitioning member, based on moving in the flow direction of the fuel gas.

The guide surface inclined toward an axial center side of the fuel nozzle is provided on an inner wall surface of the partitioning member, based on moving in the flow direction of the fuel gas, and therefore, the fuel gas flowing along the inner wall surface of the partitioning member can be directed toward the axial center side of the fuel nozzle, and thus internal ignition can be further strengthened.

Furthermore, in the combustion burner according to one aspect of the present invention, the combustion burner air nozzle has an area of a surface surrounded by an outer surface that decreases with regard to an upstream end portion in the flow direction of the fuel gas, when approaching a tip end side. Thereby, even with a shape where the combustion burner air nozzle is narrowed, by providing the partitioning member, a difference in flow rate at a boundary between combustion burner air and fuel gas can be reduced, and thus ignition in a high-temperature and high-oxygen region can be suppressed. Furthermore, the flow rate around the flame stabilizer is reduced, and thus ignition in the fuel gas flow can be promoted.

Furthermore, the combustion burner according one aspect of the present invention, further includes a guide member provided on a more upstream side than the partitioning member of the fuel nozzle, that guides the fuel gas flowing inside the fuel nozzle to an axial center side. Therefore, solid fuel flowing inside the fuel nozzle can be moved to an axial center side of the nozzle by the guide member, and fuel gas with a high solid fuel concentration can be supplied into the casing member, and thus the performance of internal flame stabilizing can be enhanced.

Furthermore, in the combustion burner according to one aspect of the present invention, a secondary air nozzle that can inject air from the outside of the combustion burner air nozzle is further provided; the secondary air nozzle has a surface on an axial center side with an inclination separated from the axial center based on moving toward a tip end side; and secondary air flowing inside the secondary air nozzle is discharged in a direction guided to the axial outside, isolated from air injected by the combustion burner air nozzle. Therefore, the combustion burner air can be suctioned in a direction separated from an axial center, and thus ignition at a boundary between the combustion burner air and fuel gas can be suppressed.

Furthermore, in the combustion burner according to one aspect of the present invention, the flame stabilizer forms a structure where two parallel first flame stabilizing members that extend along a horizontal direction and have a predetermined gap in a vertical direction, and two parallel second flame stabilizing members that extend along a vertical direction and that have a predetermined gap in a horizontal direction are provided so as to intersect. The flame stabilizer has the aforementioned shape, and therefore, internal flame stabilizing can be preferably generated.

Furthermore, in the combustion burner according to one aspect of the present invention, the flame stabilizer includes: an upstream side flame stabilizing member provided on an upstream side of a fuel gas flow; and a downstream side flame stabilizing member provided on a downstream side of the fuel gas with regard to the upstream side flame stabilizing member.

The flame stabilizing members are sorted in a fuel gas flow direction and provided in a stepped manner, and therefore, the flow channel cross-sectional area narrowed by including a flame stabilizing member can be reduced as much as possible. Thereby, acceleration of the fuel gas flowing in the inner flow channel can be suppressed, and the flow rate of the fuel gas flowing through the inner flow channel can be brought near the combustion rate to enhance internal ignition.

Furthermore, in the combustion burner according to one aspect of the present invention, the flame stabilizer has a widened portion on a downstream side in the flow direction of the fuel gas. The flame stabilizer has the aforementioned shape, and therefore, internal flame stabilizing can be preferably generated.

Furthermore, a boiler according to one aspect of the present invention includes: a furnace; the combustion burner installed in the furnace; and a heat exchanger that exchanges heat with the combustion gas from the combustion burner at a downstream side of the furnace.

The aforementioned combustion burner is provided, and therefore, a boiler in which NOx is exhaust gas is reduced can be provided.

Advantageous Effects of Invention

The flow channel cross-sectional area of an inner flow channel is expanded in the flow direction of the fuel gas by a partitioning member, and therefore, the flow rate of fuel gas flowing through the inner flow channel can be reduced and the flow rate of the fuel gas can be brought near to a combustion rate to suppress flame blow-off or the like and to achieve ignition that is stable in a flame stabilizer. Thereby, internal flame stabilizing where a flame is stabilized inside a combustion burner is enhanced and reduction due to oxygen deficient combustion is effectively performed, and therefore, NOx can be reduced.

DESCRIPTION OF EMBODIMENTS

Preferred examples of a combustion burner according to one aspect of the present invention are described in detail below, while referring to the attached drawings. Note that the present invention is not restricted to these examples, and when a plurality of examples are present, the present invention is intended to include a configuration that combines the examples.

EXAMPLE 1

Figure 1:
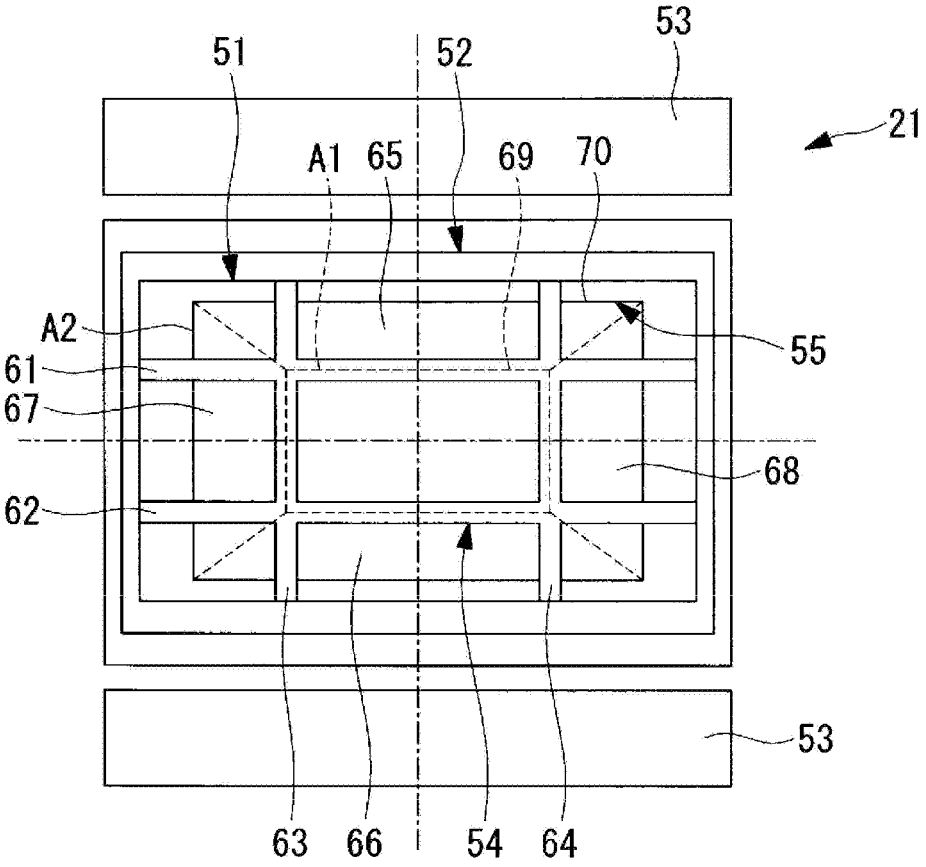
FIG. 1 is a front view illustrating a combustion burner according to Example 1 of the present invention.
Figure 2:
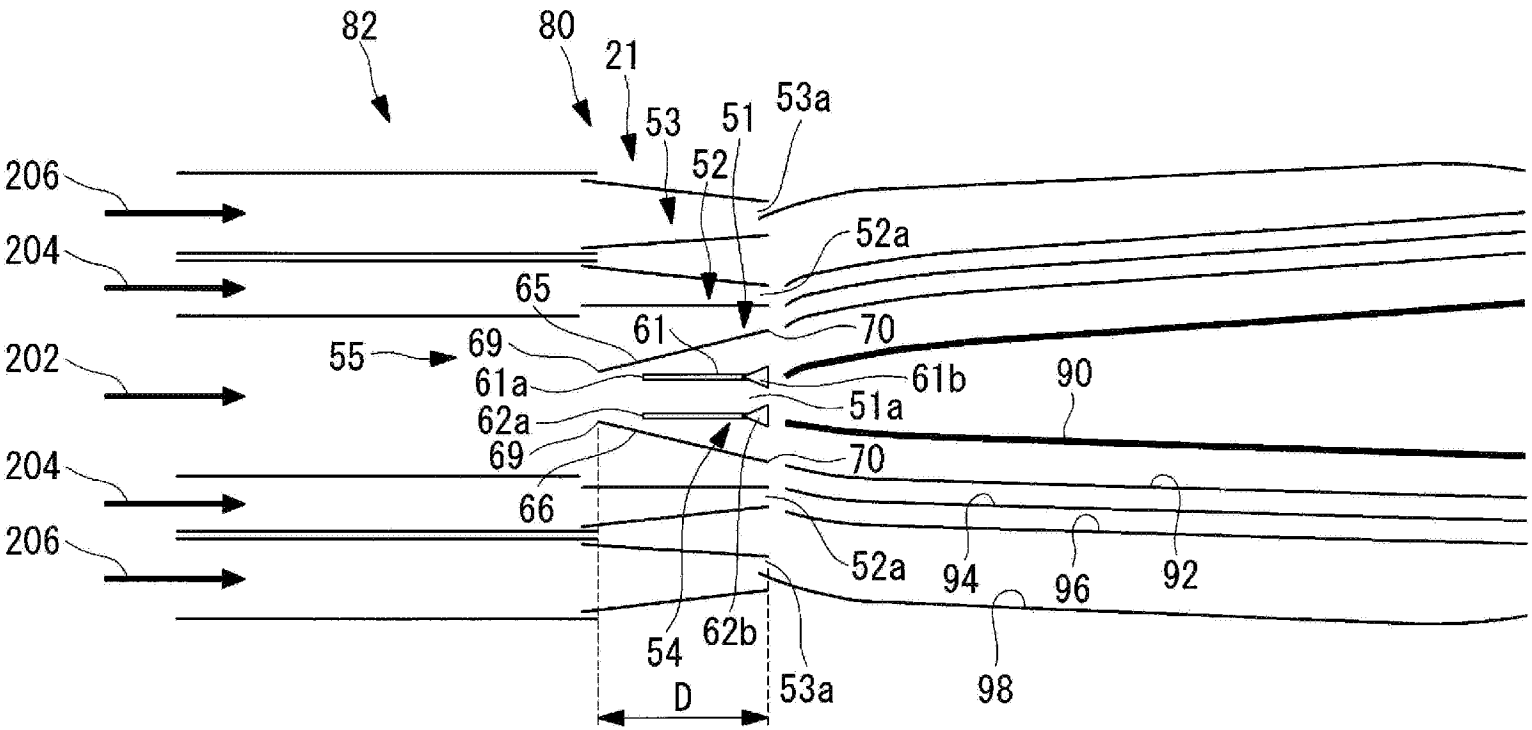
FIG. 2 is a longitudinal cross-sectional view illustrating the combustion burner of Example 1.
Figure 3:
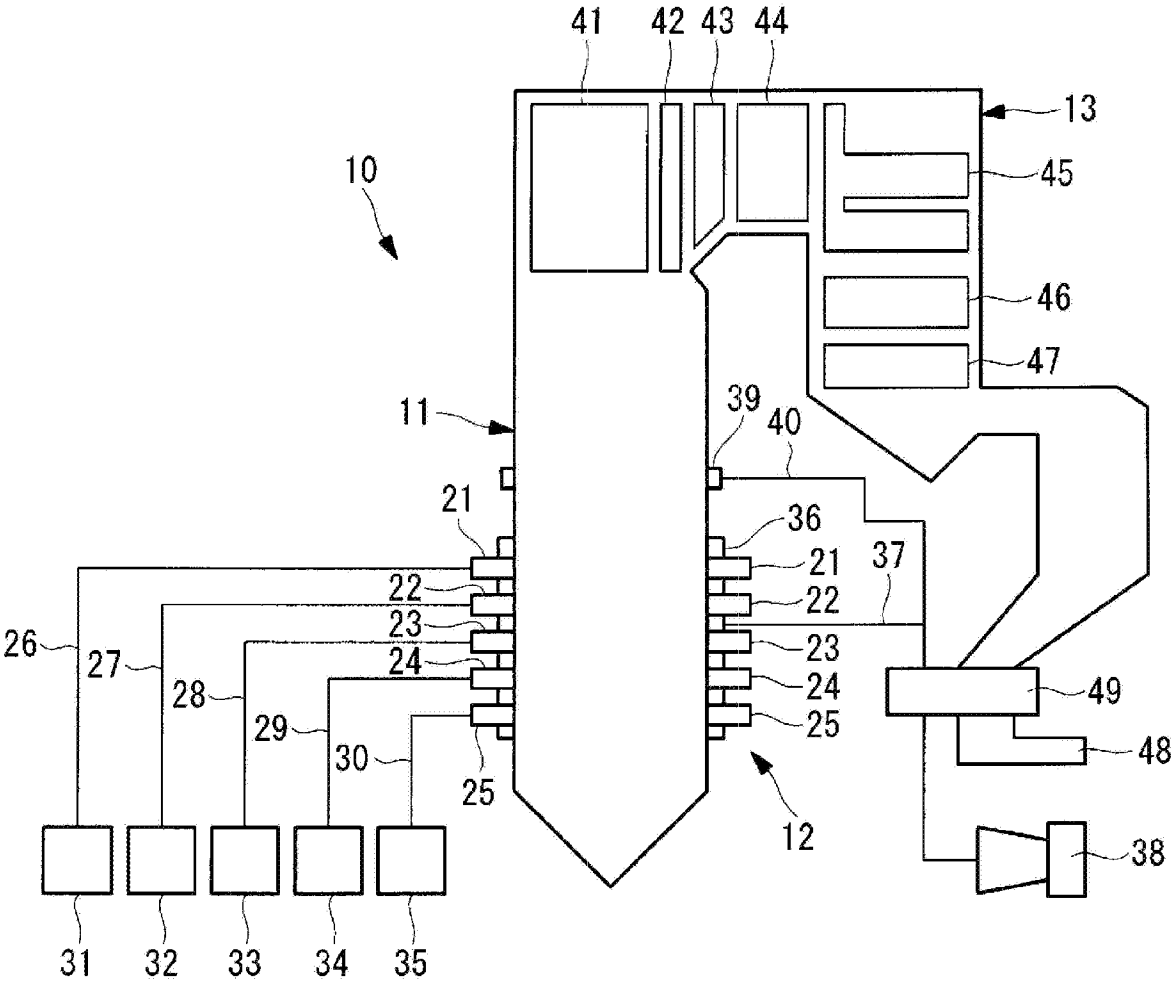
FIG. 3 is a schematic configuration diagram illustrating a pulverized coal burning boiler in which the combustion burner of Example 1 is applied.
Figure 4:
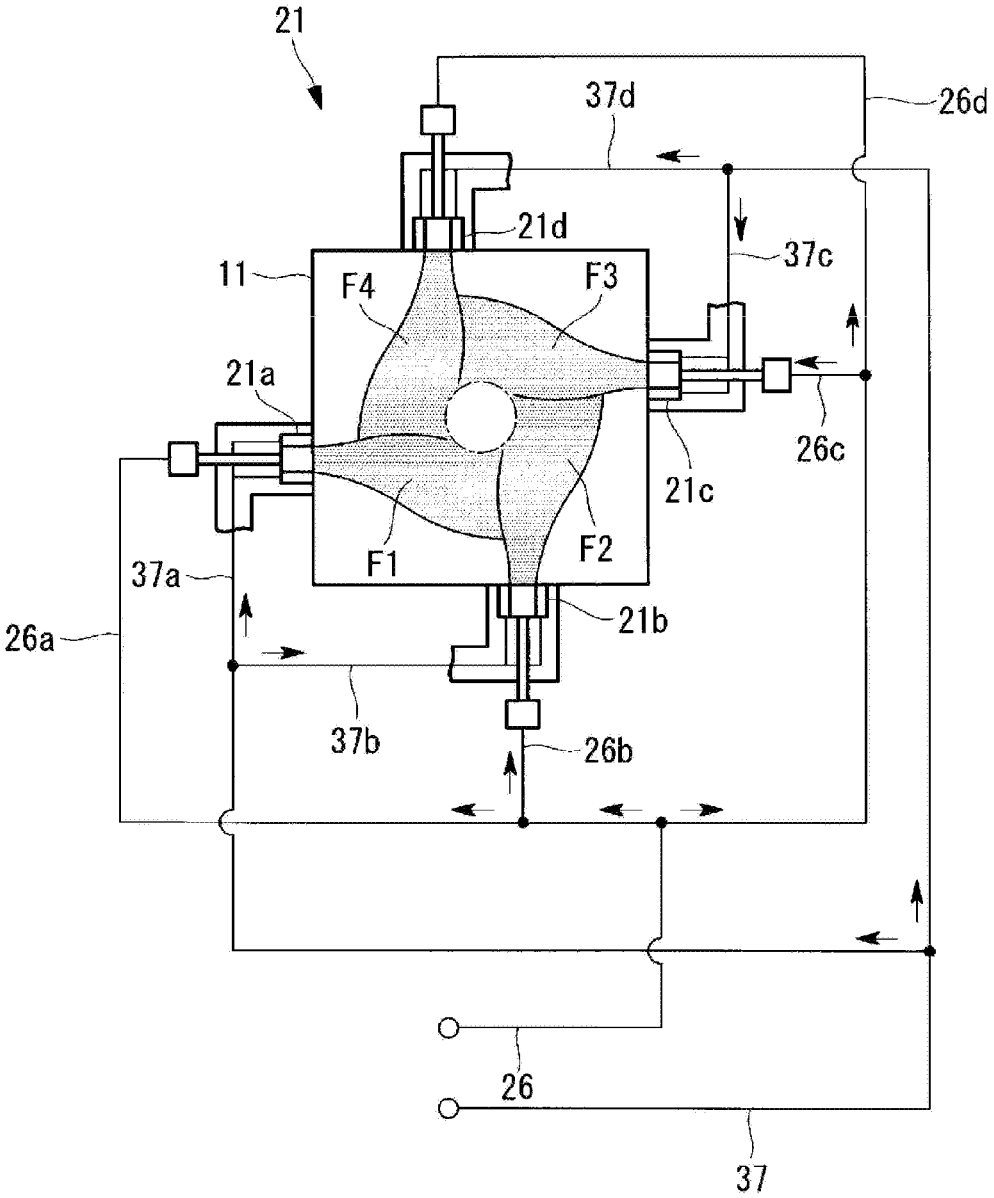
FIG. 4 is a plan view illustrating the combustion burner in the pulverized coal burning boiler of Example 1.

FIG. 1 is a front view illustrating a combustion burner according to Example 1 of the present invention; FIG. 2 is a longitudinal cross-sectional view illustrating the combustion burner of Example 1; FIG. 3 schematic configuration diagram illustrating a pulverized coal burning boiler in which the combustion burner of Example 1 is applied; and FIG. 4 is a plan view illustrating the combustion burner in the pulverized coal burning boiler of Example 1.

The pulverized coal burning boiler in which the combustion burner of Example 1 is applied is a boiler that uses pulverized coal where coal is pulverized as solid fuel, combusts the pulverized coal by the combustion burner, and can recover heat generated by combustion.

In Example 1, a pulverized coal burning boiler 10 is a conventional boiler having a furnace 11, combustion device 12, and flue 13, as illustrated in FIG. 3. The furnace 11 forms a hollow square tube shape and is installed in a vertical direction, and the combustion device 12 is provided on a lower portion of a furnace wall configuring the furnace 11.

The combustion device 12 has a plurality of combustion burners 21, 22, 23, 24, 25 mounted to a furnace wall. In the present example, the combustion burners 21, 22, 23, 24, 25 are arranged as a set of five burners along a vertical direction, set at four even intervals in a circumferential direction, and are in other words, arranged in five levels.

Furthermore, the combustion burners 21, 22, 23, 24, 25 are connected to coal pulverizing machines (mills) 31, 32, 33, 34, 35 through pulverized coal supplying tubes 26, 27, 28, 29, 30. Although not illustrated in the drawings, the coal pulverizing machines 31, 32, 33, 34, 35 are configured such that a mill table is supported so as to be drivable and rotatable on a rotation axis along a vertical direction in a housing, and a plurality of mill rollers facing above the mill table are supported so as to be rotatable in conjunction with the rotation of the mill table. Therefore, when coal is introduced between the plurality of mill rollers and mill table, the coal is pulverized herein to a predetermined size, and then the pulverized coal sorted by transporting air (air) is supplied from the pulverized coal supplying tubes 26, 27, 28, 29, 30 to the combustion burners 21, 22, 23, 24, 25.

Furthermore, the furnace 11 has a windbox 36 provided at a mounting position of the combustion burners 21, 22, 23, 24, 25, a first end portion of an air duct 37 is connected to the windbox 36, and a blower 38 is mounted to a second end portion of the air duct 37. Furthermore, the furnace 11 has an additional air nozzle 39 provided more above the mounting position of the combustion burners 21, 22, 23, 24, 25, and an end portion of a branched air duct 40 branched from the air duct 37 connected to the additional air nozzle 39. Therefore, combustion air (combustion burner air (fuel gas combustion air), secondary air) sent from the blower 38 can be supplied to the windbox 36 from the air duct 37, and supplied to the combustion burners 21, 22, 23, 24, 25 from the windbox 36, and the combustion air (additional air) sent from the blower 38 can be supplied from the branched air duct 40 to the additional air nozzle 39.

Therefore, the combustion burners 21, 22, 23, 24, 25 in the combustion device 12 can inject a pulverized fuel-air mixture (fuel gas) in which pulverized coal and air are mixed into the furnace 11, and can inject combustion burner air and secondary air into the furnace 11, and thus a flame can be formed by igniting the pulverized fuel-air mixture by an igniting torch not illustrated in the drawings.

Note that in general, when the boiler is activated, the combustion burners 21, 22, 23, 24, 25 form a flame by spraying petroleum fuel into the furnace 11. Alternatively, when a flame is formed by an oil burning burner for activation, combustion burner air is supplied from the oil burning burner during normal operation.

The flue 13 is connected to an upper portion of the furnace 11; superheaters 41, 42, reheaters 43, 44, and economizers 45, 46, 47 for recovering exhaust gas heat are provided as convection heat transferring parts on the flue 13; and heat exchanging is performed between water and exhaust gas generated by combustion in the furnace 11.

An exhaust gas tube 48 in which heat exchanged exhaust gas is emitted is connected on a downstream side of the flue 13. The exhaust gas tube 48 has an air heater 49 provided between the air duct 37, heat exchanging is performed between air flowing through the air duct 37 and exhaust gas flowing through the exhaust gas tube 48, and thus the temperature of the combustion air supplied to the combustion burners 21, 22, 23, 24, 25 can be increased.

Note that although not illustrated in the drawings, the exhaust gas tube 48 provides a denitrifying device, electrical dust collector, induced draft fan, and desulfurizing device, and a funnel is provided on a downstream end portion.

Therefore, when the coal pulverizing machines 31, 32, 33, 34, 35 are driven, the produced pulverized coal is supplied to the combustion burners 21, 22, 23, 24, 25 through the pulverized coal supplying tubes 26, 27, 28, 29, 30 along with the transporting air. Furthermore, heated combustion air is supplied from the air duct 37 to the combustion burners 21, 22, 23, 24, 25 through the windbox 36, and supplied from the branched air duct 40 to the additional air nozzle 39. Therefore, a pulverized fuel-air mixture in which pulverized coal and transporting air are mixed is injected into the furnace 11 while injecting combustion air into the furnace 11, and thus the combustion burners 21, 22, 23, 24, 25 can form a flame by igniting at this time. Furthermore, the additional air nozzle 39 injects additional air into the furnace 11, and thus combustion control can be performed. In the furnace 11, the pulverized fuel-air mixture and combustion air are combusted to produce a flame, and when the flame is produced at a lower portion in the furnace 11, the combustion gas (exhaust gas) rises inside the furnace 11 and is emitted to the flue 13.

In other words, the combustion burners 21, 22, 23, 24, 25 injects the pulverized fuel-air mixture and combustion air (combustion burner air/secondary air) into a combustion region in the furnace 11, and thus a flame swirling flow is formed in the combustion region by igniting at this time. Furthermore, the flame swirling flow rises while swirling to reach a reduction region. The additional air nozzle 39 injects additional air above the reduction region in the furnace 11. In the furnace 11, the amount of supplied air is set so as to be less than a theoretical amount of air with regard to the amount of supplied pulverized coal, and therefore, a reducing atmosphere is maintained inside. Furthermore, NOx generated by combustion of pulverized coal is reduced in the furnace 11, and then oxidizing combustion of the pulverized coal is completed by supplying additional air (additional air), and the amount of NOx generated by pulverized coal combustion is reduced.

At this time, water supplied from a water supplying pump not illustrated in the drawings is preheated by the economizers 45, 46, 47, and then is supplied to a steam drum not illustrated in the drawings, heated to saturated steam while supplying to water tubes (not illustrated) on a furnace wall, and then sent to the steam drum not illustrated in the drawings. Furthermore, the saturated steam in the steam drum not illustrated in the drawings is introduced to the superheaters 41, 42, and then superheated by combustion gas. Superheated steam generated by the superheaters 41, 42 is supplied to a power plant (such as a turbine or the like) not illustrated in the drawings. Furthermore, steam extracted during an expanding process in the turbine is introduced to the reheaters 43, 44, superheated again, and then returned to the turbine. Note that the furnace 11 is described as a drum type (steam drum), but is not limited to this structure.

Next, exhaust gas passing through the economizers 45, 46, 47 of the flue 13 is emitted into the atmosphere from a funnel, after hazardous substances such as NOx and the like are removed by a denitrifying device not illustrated in the drawings, particulate substances are removed by an electrical dust collector, and sulfur content is removed by a desulfurizing device, in the exhaust gas tube 48.

Herein, the combustion device 12 is described in detail, and the combustion burners 21, 22, 23, 24, 25 configuring the combustion burner 12 form essentially the same configuration, and therefore, only the combustion burner 21 positioned at an uppermost level is described.

As illustrated in FIG. 4, the combustion burner 21 is configured from combustion burners 21*a*, 21*b*, 21*c*, 21*d* provided on four wall surfaces in the furnace 11. The combustion burners 21*a*, 21*b*, 21*c*, 21*d* has branched tubes 26*a*, 26*b*, 26*c*, 26*d* branched from the pulverized coal supplying tube 26 that are connected and branched tubes 37*a*, 37*b*, 37*c*, 37*d* branched from the air duct 37 that is branched.

Therefore, the combustion burners 21*a*, 21*b*, 21*c*, 21*d* on the wall surfaces of the furnace 11 inject a pulverized fuel-air mixture in which pulverized coal and transporting air are mixed into the furnace 11 and inject combustion air to an outer side of the pulverized fuel-air mixture. Furthermore, the pulverized fuel-air mixture from the combustion burners 21*a*, 21*b*, 21*c*, 21*d* is ignited, and therefore, four flames F1, F2, F3, F4 can be formed, and the flames F1, F2, F3, F4 form a flame swirling flow swirling in a counterclockwise circumferential direction as viewed from above the furnace 11 (FIG. 4).

As illustrated in FIG. 1 and FIG. 2, in the combustion burner 21 (21*a*, 21*b*, 21*c*, 21*d*) configured in this manner, a fuel nozzle 51, a combustion burner air nozzle 52, and a secondary air nozzle 53 are provided from a center side, and a flame stabilizer 54 and casing member (partitioning member) 55 are provided. The fuel nozzle 51 can inject fuel gas (pulverized fuel-air mixture, air) in which pulverized coal (solid fuel) and transporting air (air, primary air) are mixed, as illustrated by arrow 202. The combustion burner air nozzle (combustion air nozzle) 52 is provided on an outer side of the fuel nozzle 51, can inject fuel air (combustion burner air, fuel gas combustion air, coal secondary air) on an outer circumferential side of the fuel gas sprayed from the fuel nozzle 51, as illustrated by arrow 204. The secondary air nozzle 53 is provided at a position outside of the combustion burner air nozzle 52 and an upper side in a vertical direction of the combustion burner air nozzle 52, and a positioned outside of the combustion burner air nozzle 52 and a lower side in a vertical direction of the combustion burner air nozzle 52. In this case, vertical direction also includes a direction deviating at a very small angle with regard to a vertical direction. The secondary air nozzle 53 is not provided at a position outside of the combustion burner air nozzle 52, which is adjacent in a horizontal direction. The secondary air nozzle 53 can inject secondary air (AUX) to an outer circumferential side of the combustion burner air sprayed from the combustion burner air nozzle 52, as illustrated by arrow 206. Furthermore, the secondary air nozzle 53 may be provided at a position outside of the combustion burner air nozzle 52, which is adjacent in a horizontal direction. Furthermore, the secondary air nozzle 53 may be provided at a position outside of the combustion burner air nozzle 52, which is adjacent in a horizontal direction, and does not need to be provided at a position adjacent in a vertical direction. The secondary air nozzle 53 may be provided on an entire circumference outside of the combustion burner air nozzle 52. The secondary air nozzle 53 may provide a damper opening adjusting mechanism or the like such that the amount of discharged secondary air can be adjusted.

The fuel nozzle 51, combustion burner air nozzle 52, and secondary air nozzle 53 of the combustion burner 21 have a burner angle adjusting part 80 and a pipe line portion 82 connected in a condition freely slidable on the burner angle adjusting part 80. The burner angle adjusting part 80 is at a tip end of the fuel nozzle 51, combustion burner air nozzle 52, and secondary air nozzle 53 of the combustion burner 21, and is supported in a condition movable in a set direction with regard to the pipe line portion 82. The direction that the burner angle adjusting part 80 can be moved is not particularly limited, and may be movable in an axial direction (vertical direction) of the furnace 11 or movable in a cross-sectional direction (horizontal direction) of the furnace 11. For the combustion burner 21, the direction of the burner angle adjusting part 80 is adjusted to adjust the injecting direction of the pulverized fuel-air mixture in which pulverized coal and transporting air are mixed. The pipe line portion 82 is connected to the burner angle adjusting part 80, a pipe line corresponding to the fuel nozzle 51, combustion burner air nozzle 52, and secondary air nozzle 53 is formed, and fuel gas in which pulverized coal and air are mixed, combustion burner air, and secondary air are supplied to each part of the burner angle adjusting part 80. The pipe line portion 82 forms an elongated tubular structure.

The fuel nozzle 51 has a portion on a tip end side, in other words, a portion corresponding to the burner angle adjusting part 80 that is a straight pipe, and the area (flow channel cross-sectional area) of a cross section (opening) orthogonal in a direction in which the pulverized fuel-air mixture is injected is constant. The combustion burner air nozzle 52 has a portion on a tip end side, in other words, a portion corresponding to the burner angle adjusting part 80 that is in a shape that narrows when approaching a tip end, and an area (flow channel cross-sectional area) of a cross section (opening) orthogonal in a direction in which the pulverized fuel-air mixture is injected that decreases when approaching a tip end. In other words, the combustion burner air nozzle 52 has a shape where an area of a surface surrounded by an outer surface decreases with regard to an upstream end portion in the flow direction of the fuel gas. The secondary air nozzle 53 has a portion on a tip end side, in other words, a portion corresponding to the burner angle adjusting part 80 that is in a shape that narrows when approaching a tip end, and an area (flow channel cross-sectional area) of a cross section (opening) orthogonal in a direction in which the pulverized fuel-air mixture is injected that decreases when approaching a tip end.

Note that the shape of the opening of the fuel nozzle 51 and combustion burner air nozzle 52 is not restricted to a square, and may be a rectangle or in this case, a shape with a curved corner. By using a tubular structure with a curved corner, the nozzle strength can be enhanced. Furthermore, a cylinder shape may also be used.

The flame stabilizer 54 is inside the fuel nozzle 51, and is provided on an axial center side and on a downstream side in an injecting direction of the fuel gas, and therefore, functions to ignite and stabilize the flame of the fuel gas. The flame stabilizer 54 forms a so-called double-cross split structure provided such that first flame stabilizing members 61, 62 along a horizontal direction and second flame stabilizing members 63, 64 along a vertical direction (up and down direction) form a cross shape. Furthermore, the first flame stabilizing members 61, 62 have flat portions 61*a*, 62*a* that form a plate shape with a constant thickness, and widened portions 61*b*, 62*b* integrally provided on a front end portion (downstream end portion in the flow direction of the fuel gas) of the flat portions 61*a*, 62*a*. The widened portions 61*b*, 62*b* have a cross section that forms an isosceles triangle shape, a width that widens when approaching a downstream side in the flow direction of the fuel gas, and a front end that forms a flat surface orthogonal to a flow direction of the fuel gas. Note that the widened portions 61*b*, 62*b* are not limited to a cross section with an isosceles triangle shape, and may be a split shape that separates the flow of fuel gas to form a recirculation region on a downstream side, where the cross section may form a Y shape for example. Furthermore, although not illustrated in the drawings, the second flame stabilizing members 63, 64 form the same structure.

Therefore, the fuel nozzle 51 and combustion burner air nozzle 52 have an elongated tubular structure. The fuel nozzle 51 has a rectangular opening portion 51*a*, and the combustion burner air nozzle 52 has a rectangular ring shaped opening portion 52*a*, and therefore, the fuel nozzle 51 and combustion burner air nozzle 52 form a double tube structure. The secondary air nozzle 53 is provided as a double tube structure on an outer side of the fuel nozzle 51 and combustion burner air nozzle 52, and has a rectangular ring shaped opening portion 53*a*. As a result, the opening portion 52*a* of the combustion burner air nozzle 52 is provided on an outer side of the opening portion 51*a* of the fuel nozzle 51, and the opening portion 53*a* of the secondary air nozzle 53 is provided on an outer side of the opening portion 52*a* of the combustion burner air nozzle 52. Note that the secondary air nozzle 53 may provide a plurality of separate nozzles on an outer circumferential side of the combustion burner air nozzle 52 as the secondary air nozzle, without providing as a double tube structure.

The nozzles 51, 52, 53 are provided such that the opening portions 51*a*, 52*a*, 53*a* are aligned on the same surface. Furthermore, the flame stabilizer 54 is supported by an inner wall surface of the fuel nozzle 51 or material not illustrated in the drawings from an upstream side of a flow channel in which the fuel gas flows. Furthermore, the plurality of flame stabilizers 61, 62, 63, 64 are provided as the flame stabilizer 54 in a double split structure inside the fuel nozzle 51, and therefore, the flow channel of the fuel gas is divided into nine. Furthermore, for the flame stabilizer 54, the widened portions 61*b*, 62*b* where the width widens on a front end portion, and the widened portions 61*b*, 62*b* have a front end surface that is aligned with the opening portion 51*a*.

Furthermore, in the combustion burner 21 of Example 1, a casing member 55 that reduces the flow rate of the fuel gas flowing inside the axial center side of the fuel gases flowing inside the fuel nozzle 51 is inside the fuel nozzle 51, and more precisely, at a position including a tip end of the fuel nozzle 51, and is provided on a portion corresponding to the burner angle adjusting part 80. An inner flow channel in which the flame stabilizer 54 is provided, and an outer flow channel on an outer side of the inner flow channel are partitioned by the casing member 55. The casing member 55 has a shape where a flow channel cross-sectional area of the inner flow channel surrounded by the casing member 55 increases when approaching a downstream side from an upstream side in the flow direction of the fuel gas, in other words, when approaching an opening of a tip end, as illustrated in FIG. 1 and FIG. 2.

The casing member 55 is a square tube with a cross section having a square shape, and is provided inside the fuel nozzle 51. The casing member 55 has: a plate member 65 provided between the flame stabilizing member 61 and an upper wall surface of the combustion burner air nozzle 52; plate member 66 provided between the flame stabilizing member 62 and a lower wall surface of the combustion burner air nozzle 52; a plate member 67 provided between the flame stabilizing member 63 and side wall surface of the combustion burner air nozzle 52; and a plate member 68 provided between the flame stabilizing member 64 and a side wall surface of the combustion burner air nozzle 52. At a cross section orthogonal to a flow direction of the fuel gas, end portions of the plate member 65, 66, 67, 68 of the casing member 55 are connected to form a square tube. The casing member 55 surrounds a portion on an axial center side of the fuel nozzle 51 of the flame stabilizer 54, which in the present example, is a portion forming a square shape by the flame stabilizing members 61, 62, 63, 64. The plate members 65, 66, 67, 68 have an end portion on an upstream side in the flow direction of the fuel gas that is on the upstream side of the flame stabilizer 54, and an end portion on a downstream side in the flow direction of the fuel gas at the same position as the end portion on the downstream side of the flame stabilizer 54. Furthermore, the casing member 55 is inclined in a direction where the plate members 65, 66, 67, 68 are separated from an axial center of the fuel nozzle 51, when approaching downstream from upstream in the flow direction of the fuel gas, in other words, when approaching an opening of a tip end (opening for spraying the fuel gas). Furthermore, the plate members 65, 66, 67, 68 are bonded to the flame stabilizing members 61, 62, 63, 64 at a position overlapping the flame stabilizing members 61, 62, 63, 64. Thereby, the flame stabilizing members 61, 62, 63, 64 penetrate the plate members 65, 66, 67, 68 at an overlapping position. Thereby, the casing member 55 has a shape where the area of an inner portion surrounded by the casing member 55 increases when approaching an opening of a tip end in the flow direction of the fuel gas. For the casing member 55, if an area of an opening 69 of an end portion on an upstream side in the flow direction of the fuel gas is set to A1, and an area of an opening 70 of an end portion on a downstream side in the flow direction of the fuel gas is set to A2, the area A1 is smaller than the area A2.

Therefore, in the combustion burner 21, fuel gas in which pulverized coal and air are mixed is injected into the furnace from the opening portion 51*a* of the fuel nozzle 51, combustion burner air is injected into the furnace from the opening portion 52*a* of the combustion burner air nozzle 52 on an outer side thereof, and secondary air is injected into the furnace from the opening portion 53*a* of the secondary air nozzle 53 at an outer side thereof. At this time, the fuel gas is injected into both the inner flow channel and outer flow channel partitioned by the casing member 55. Of the combustion gases, the combustion gas injected inside the casing member 55 is combustion gas that is obtained by branching and igniting by the flame stabilizer 54 and then combusting, at the opening portion 51*a* of the fuel nozzle 51. Of the combustion gases, the combustion gas injected outside the casing member 55 is combusted by a flame ignited by the flame stabilizer 54. Furthermore, the combustion burner air is injected to an outer circumference of the combustion gas, and therefore, combustion of the fuel gas is promoted. Furthermore, secondary air is injected to an outer circumference of the combustion flames, and therefore, the ratio of combustion burner air and secondary air can be adjusted, and thus optimal combustion can be achieved.

Furthermore, in the combustion burner 21, the flame stabilizer 54 forms a split shape, and therefore, the combustion gas is branched by the flame stabilizer 54 at the opening portion 51*a* of the fuel nozzle 51. At this time, the fuel stabilizer 54 is provided in a center region of the opening portion 51*a* of the fuel nozzle 51, and ignition and flame stabilizing of the fuel gas are performed in the center region. Thereby, internal flame stabilizing of the combustion flame (flame stabilizing in a center region of the opening portion 51*a* of the fuel nozzle 51) is performed.

Therefore, as compared to a configuration where external flame stabilizing of a combustion flame is performed, an outer circumferential portion of the combustion flame has a low temperature as well as low oxygen due to oxygen being consumed from inside the flame, and therefore, the temperature of an outer circumferential portion of the combustion flame in a high oxygen atmosphere can be reduced by the combustion burner air, and the amount of generated NOx in the outer circumferential portion of the combustion flame can be reduced.

Herein, in the combustion burner 21, an internal flame stabilizing configuration is adopted, and therefore, the combustion gas and combustion air (combustion burner air and secondary air) are preferably supplied as a straight flow. In other words, the fuel nozzle 51, combustion burner air nozzle 52, and secondary air nozzle 53 preferably have a configuration that supplies the combustion gas, combustion burner air, and secondary air as a straight flow in a burner axial center direction without swirling. The combustion gas, combustion burner air, and secondary air are sprayed as a straight flow and a combustion flame is formed, and therefore, in a configuration with internal flame stabilizing of a combustion flame, gas circulation in the combustion flame is suppressed. Thereby, the outer circumferential portion of the combustion flame is maintained at low temperature, and the amount of generated NOx is reduced by mixing with the combustion burner air.

Furthermore, in the combustion burner 21, the casing member 55 is provided where the flow channel cross-sectional area in the inner flow channel increases when approaching an opening of a tip end of the fuel nozzle 51, and therefore, the flow rate of the fuel gas flowing through the inner flow channel can be reduced. Thereby, flame blow-off is suppressed by making the flow rate of the fuel gas to approach the combustion rate, and therefore, a more stable flame is possible. Therefore, internal flame stabilizing is enhanced, and therefore, a high-temperature and high-oxygen region which can occur on an outer circumferential side of the fuel nozzle 51 can be suppressed, and thus NOx can be reduced.

Furthermore, the flow channel cross-sectional area in the outer flow channel partitioned by the casing member 55 in the combustion burner 21 is reduced in the flow direction of the fuel gas, and therefore, of the fuel gases injected into the furnace by the fuel nozzle 51, the flow rate of the fuel gas in the outer flow channel flowing in near the combustion burner air injected by the combustion burner air nozzle 52 can be further increased. Thereby, the difference in flow rate between the combustion burner air and fuel gas flowing through the outer flow channel can be reduced, and ignition at a boundary of the combustion burner air and fuel gas flowing through the outer flow channel, in other words, external ignition can be suppressed.

As an example, fuel gas 90 passing between the flame stabilizing member 61 and flame stabilizing member 62 of the flame stabilizer 54 is sprayed from the combustion burner 21 at a low flow rate such as 10 m/s for example, and then internally ignited. The fuel gas 90 passing through a space surrounded by the casing member 55, which is more outside than between the flame stabilizing member 61 and flame stabilizing member 62 of the flame stabilizer 54, is sprayed from the combustion burner 21 at a low flow rate such as 10 m/s for example, and then internally ignited. The fuel gas 90 passing through a space surrounded by the fuel nozzle 51, which is more outside than the space surrounded by the casing member 55, is sprayed from the combustion burner 21 at a higher flow rate than the fuel gas on the inside, such as 30 m/s for example. Combustion burner air passing through a space surrounded by the combustion burner air nozzle 52, which is more outside than the space surrounded by the fuel nozzle 51, is sprayed from the combustion burner 21 at a higher flow rate than the fuel gas on the inside, such as 40 m/s for example. Secondary air passing through a space surrounded by the secondary air nozzle 53, which is more outside than the space surrounded by the combustion burner air nozzle 52, is sprayed from the combustion burner 21 at a higher flow rate than the fuel gas on the inside, such as 60 m/s for example.

Therefore, the combustion burner in Example 1 provides the fuel nozzle 51 that can inject fuel gas in which pulverized coal and air are mixed, and the combustion burner air nozzle 52 that can inject combustion burner air from outside the fuel nozzle 51, provides the flame stabilizer 54 on an axial center side of a tip end portion of the fuel nozzle 51, and provides the casing member 55 that reduces the flow rate of the fuel gas flowing on an axial center side in the fuel nozzle 51, and increases the flow rate of the fuel gas flowing on the combustion burner air nozzle 52 side.

Therefore, of the fuel gases flowing inside the fuel nozzle 51, the flow rate of the fuel gas flowing through the inner flow channel on an axial center side of the fuel nozzle 51, in other words, the flame stabilizer 54 side can be reduced by the casing member 55, and therefore, the flow rate can be brought near the combustion rate, and thus an easy-to-ignite condition can be achieved, and as a result, the internal flow stabilizing performance based on the flame stabilizer 54 can be improved. Interval flame stabilizing can be enhanced thereby, and therefore, combustion under a reducing atmosphere which is oxygen deficient can be promoted to further reduce NOx.

Furthermore, in the combustion burner of Example 1, of the fuel gases flowing inside the fuel nozzle 51, the flow rate of the fuel gas flowing through the outer flow channel on the combustion burner air nozzle 52 side can be increased by the casing member 55, and therefore, the difference in flow rate at a boundary between the combustion burner air and fuel gas flowing through the outer flow channel can be reduced, and external ignition which is ignition in a region in which the combustion burner air flows can be suppressed.

Herein, the combustion burner 21 in Example 1 has an end portion on a downstream side of the flame stabilizer 54 that is positioned overlapped with an end portion on a downstream side of the fuel nozzle 51, in other words, the opening portion 51*a*, but the configuration is not limited thereto. The flame stabilizer 54 of the combustion burner 21 may be provided near a tip end of the fuel nozzle 51. Herein, the area near the tip end is a nozzle interior of the combustion burner 21. If the combustion burner 21 provides the burner angle adjusting part 80 as in the present example, the flame stabilizer 54 is preferably provided inside the burner angle adjusting part 80.

Pulverized coal was described as an example for the combustion fuel, but the present invention is not restricted to pulverized coal (solid fuel), and may be a biomass (biomass chips, biomass pellets), residues, petroleum cokes, LNG shale gas, or other fuels, or mixed combustion of two or more of these fuels.

EXAMPLE 2

Figure 5:
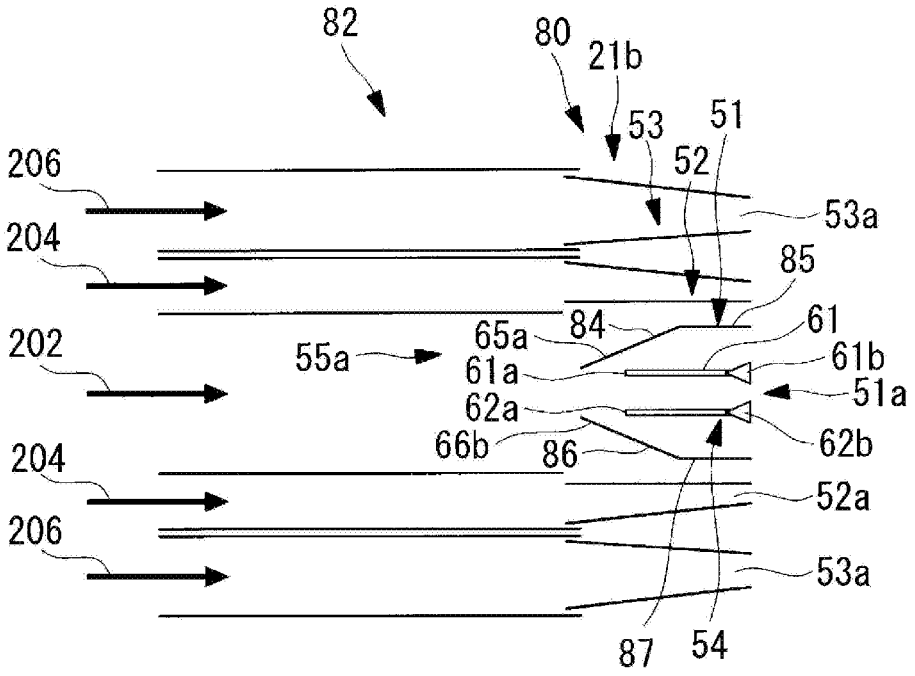
FIG. 5 is a cross-sectional view illustrating a combustion burner according to Example 2 of the present invention.

FIG. 5 is a cross-sectional view illustrating a combustion burner according to Example 2 of the present invention. Note that the same reference numerals are assigned to members having the same functions as the examples described above and a detailed description thereof is omitted.

In a combustion burner 21*a* of Example 2 illustrated in FIG. 5, the fuel nozzle 51, combustion burner air nozzle 52, and secondary air nozzle 53 are provided from a center side, and the flame stabilizer 54 and a casing member 55*a* are provided.

The casing member 55*a* has plate members 65*a*, 66*b*. The casing member 55*a* also provides a plate portion corresponding to the plate members 67, 68 of the casing member 55. The plate member 65*a* has an inclined portion 84 with regard to a flow direction of the fuel gas, and a horizontal portion 85 that is horizontal with regard to the flow direction of the fuel gas. The inclined portion 84 is provided on an upstream side of the horizontal portion 85 in the flow direction of the fuel gas, and is connected to the horizontal portion 85. The plate member 66*b* has an inclined portion 86 with regard to a flow direction of the fuel gas, and a horizontal portion 87 that is horizontal with regard to the flow direction of the fuel gas. The inclined portion 86 is provided on an upstream side of the horizontal portion 87 in the flow direction of the fuel gas, and is connected to the horizontal portion 87.

In the casing member 55*a*, the flow channel cross-sectional area of the inner flow channel increases in a region where the inclined portions 84, 86 on an upstream side in the flow direction of the fuel gas are provided, and the flow channel cross-sectional area of the inner flow channel is constant in a region where the horizontal portions 85, 87 are provided.

As in the combustion burner 21*a*, even if the flow channel cross-sectional area of the inner flow channel of the casing member 55*a* is changed in a partial region in the flow direction of the fuel gas, and the flow channel cross-sectional area of the inner flow channel is constant in a remaining region, the same effect as above can be achieved. Furthermore, in the combustion burner 21*a*, the flow channel cross-sectional area of the casing member 55*a* on a tip end side of the fuel nozzle 51 is constant, and therefore, the fuel gas can be sprayed from the nozzle in a condition rectified in a straight direction, so as to not become a cause for outer circumferential ignition due to fuel gas flow to an outer side.

The shape of the casing member of the combustion burner is not limited to the shape of the casing members 55, 55*a*, and can be various shapes. For example, the casing member may have a configuration where a plurality of tubes with different inner areas are connected in the flow direction of the fuel gas to change the shape of connecting portions. Furthermore, the casing member is not restricted to a shape where the shape of a cross section parallel to an axis forms a straight line, and may be a curved line. Herein, the casing member preferably has a shape where an inclination angle which is an angle formed between a parallel direction and flow direction of the fuel gas is reduced, in other words, the angle nears 0 when approaching a tip end side in the flow direction of the fuel gas. Thereby, peeling of fuel gas flowing through the inner flow channel which is inside the casing member can be suppressed, and the flow rate of the fuel gas can be effectively reduced.

Figure 6:
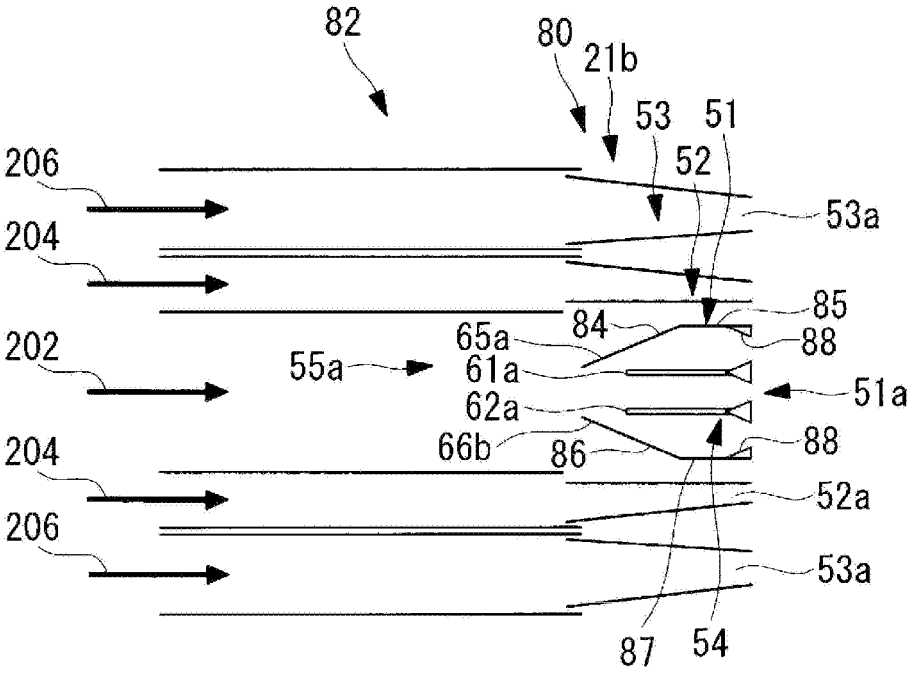
FIG. 6 is a cross-sectional view illustrating a modified example of Example 2.

Furthermore, as illustrated in FIG. 6, a guide surface 88 that is inclined to an axial center side of the fuel nozzle 51 when approaching a downstream side of the flow of the fuel gas may be provided inside a downstream end of the casing member 55*a*. The guide member 88 is preferably provided around the entire circumference of the casing member 55, but may also be partially provided. As illustrated in the same drawing, the guide member 88 may be formed as an inclined surface with a straight line shape, or formed by a curved surface. By providing the guide surface 88, the fuel gas flowing from along an inner wall surface of the casing member 55 is directed to an axial center side of the fuel nozzle 51, and thus pulverized coal can be guided to a recirculation region formed on a downstream side of the flame stabilizer 54, and internal ignition can be further strengthened.

However, in an outer side of a downstream end of the casing member 55*a*, a shape is adopted where an outer shape of the casing member 55 extends as is in a straight line form to a downstream side, without providing a guide surface protruding to the outside. This is because when a surface that guides to an outer side at a downstream end of the casing member 55, external ignition due to mixing with combustion burner air may occur.

Note that the guide surface 88 can also be applied to a configuration of the aforementioned Example 1.

EXAMPLE 3

Figure 7:
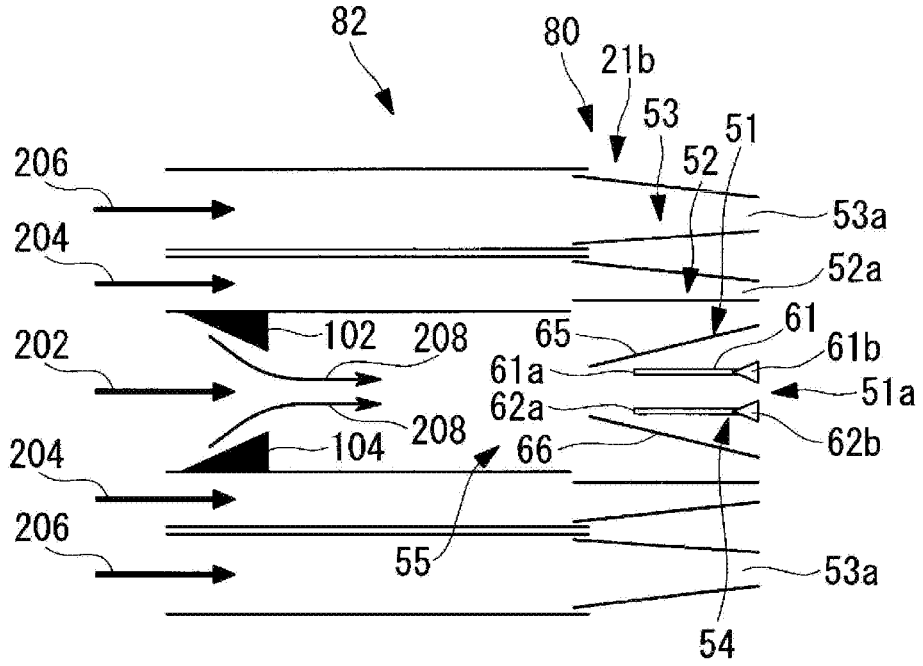
FIG. 7 is a cross-sectional view illustrating a combustion burner according to Example 3 of the present invention.

FIG. 7 is a cross-sectional view illustrating a combustion burner according to Example 3 of the present invention. Note that the same reference numerals are assigned to members having the same functions as the examples described above and a detailed description thereof is omitted. In a combustion burner 21*b* of Example 3 illustrated in FIG. 6, the fuel nozzle 51, combustion burner air nozzle 52, and secondary air nozzle 53 are provided from a center side, and the flame stabilizer 54, the casing member 55*a*, and guide members 102, 104 are provided.

The guide members 102, 104 guide the fuel gas flowing inside the fuel nozzle 51 to an axial center side to guide the fuel gas in a direction separated from combustion burner air injected by the combustion burner air nozzle 52, as illustrated by arrow 208. The guide members 102, 104 are provided on the pipe line portion 82 of the fuel nozzle 51. In other words, the guide members 102, 104 are at a position that does not face the flame stabilizer 54 and casing member 55 provided inside the fuel nozzle 51, and are provided on an upstream side in the flow direction of the fuel gas from the flame stabilizer 54 and casing member 55. Furthermore, the guide members 102, 104 are provided along a circumferential direction on an inner wall surface of the fuel nozzle 51. The guide member 102 is provided on an upper wall surface of the fuel nozzle 51, and the guide member 104 is provided on a lower wall surface of the fuel nozzle 51. Note that the guide member may also be provided on a side wall surface of the fuel nozzle 51. The guide members 102, 104 have a shape that protrudes from an inner wall surface of the fuel nozzle 51 to the flame stabilizer 54 side, and a guide surface (inclined surface or curved surface) that guides the fuel gas inside the fuel nozzle 51 to an axial center side is formed.

The combustion burner 21*b* provides the guide members 102, 104 on a pipe line portion 82 of the fuel nozzle 51, and therefore, the fuel gas flowing inside the fuel nozzle 51 is guided to an inner flow channel inside the casing member 55 which is on an axial center side, in other words, the flame stabilizer 54 side, by the guide member 102, 104. Thereby, solid fuel included in the fuel gas is moved to an axial center side, and the concentration of pulverized coal on an axial center side is increased more than the combustion burner air nozzle 52 side, in a cross section of the fuel nozzle 51. Note that primary air which is transporting gas has higher fluidity than pulverized coal, and therefore, distribution in the fuel nozzle 51 is uniform at a shorter distance than the pulverized coal. The combustion burner 21*b* provides the guide members 102, 104, and moves the pulverized coal to an axial center side on a more upstream side than the casing member 55, and therefore, the concentration of pulverized coal in the fuel gas introduced into the inner flow channel of the casing member 55 can be increased. Thereby, the concentration of the fuel near the flame stabilizer 54 can be increased, the combustion rate can be increased, and the internal flame stabilizing performance can be increased. Furthermore, fuel passing through the outer flow channel on an outer side of the casing member 55 can be reduced, and therefore, ignition at a boundary between the combustion burner air and fuel gas flowing inside the outer flow channel can be further suppressed.

Note that the guide surface 88 as illustrated in FIG. 6 may be provided on an inner side of the downstream end of the casing member 55 of the present example.

EXAMPLE 4

Figure 8:
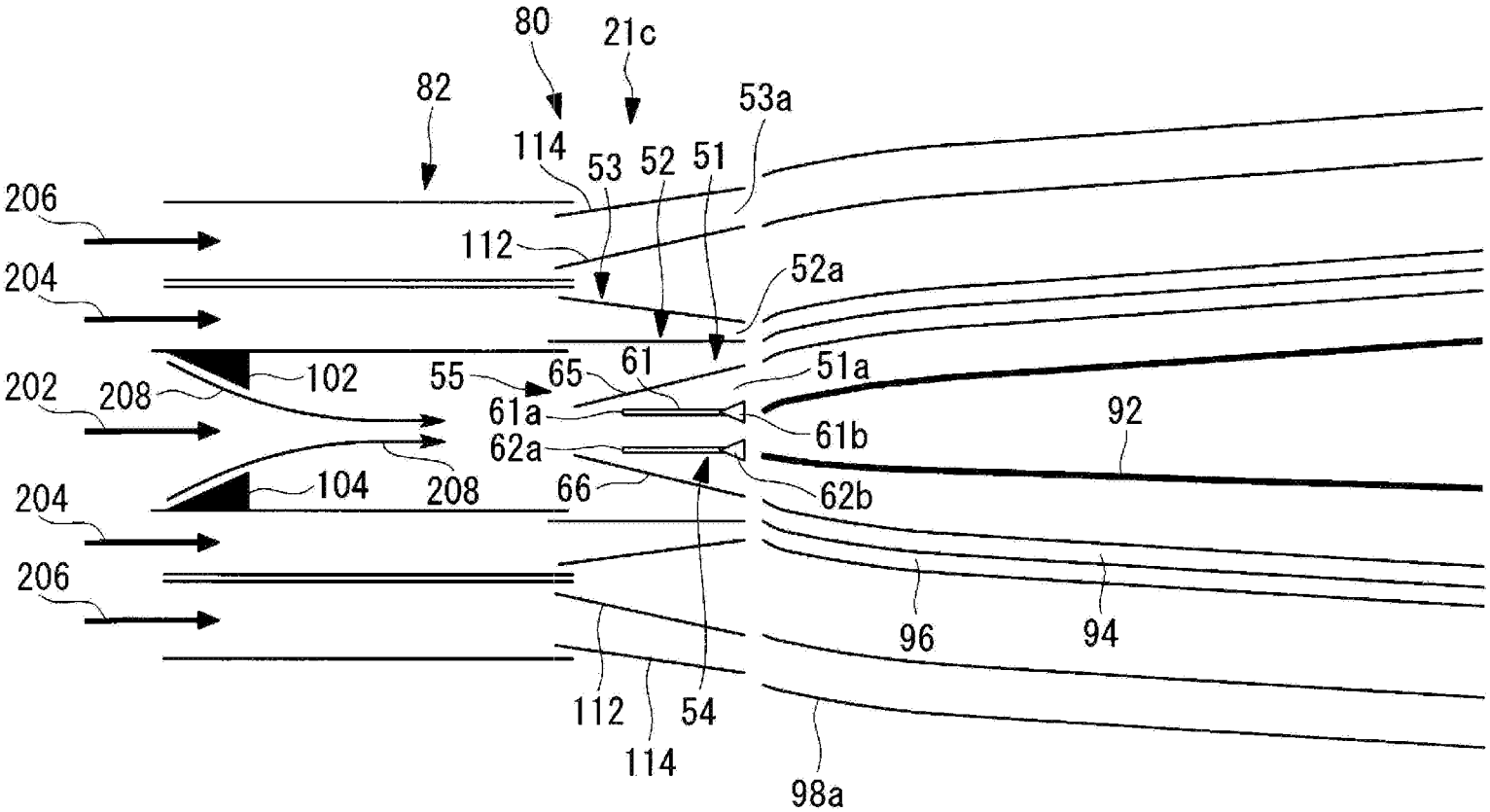
FIG. 8 is a cross-sectional view illustrating a combustion burner according to Example 4 of the present invention.

FIG. 8 is a cross-sectional view illustrating a combustion burner according to Example 4 of the present invention. Note that the same reference numerals are assigned to members having the same functions as the examples described above and a detailed description thereof is omitted. In a combustion burner 21*c* of Example 4 illustrated in FIG. 8, the fuel nozzle 51, combustion burner air nozzle 52, and secondary air nozzle 53 are provided from a center side, and the flame stabilizer 54, casing member 55*a*, and guide members 102, 104 are provided.

In the combustion burner 21*c*, an inner side surface 112 and outer side surface 114 of a portion corresponding to the burner angle adjusting part 80 which is a portion on a tip end side of the secondary air nozzle 53 are inclined in a direction separated from an axial center of the fuel nozzle 51. In other words, the inner side surface 112 and outer side surface 114 or the secondary air nozzle 53 are inclined in the same direction as the casing member 55. The secondary air nozzle 53 has the inner side surface 112 and outer side surface 114 inclined in a direction separated from an axial center of the fuel nozzle 51, and therefore, the nozzle sprays secondary air 98*a* in a direction separated from an axial center of the fuel nozzle 51. Thereby, the secondary air 98*a* is sprayed inclined in a direction separated from an axial center of the fuel nozzle 51, and therefore, combustion burner air 96 can be easily spread in a direction separated from an axial center. Thereby, the combustion burner air 96 on a boundary side with the combustion gas 94 can be reduced, and thus NOx reduction in a high-temperature and high-oxygen region in a flame outer circumference can be promoted.

In the combustion burner 21*c*, the directions of the inner side surface 112 and outer side surface 114 of the secondary air nozzle 53 are adjusted to adjust the direction of the nozzle, but the position of the secondary air nozzle 53 may also be separated from the combustion burner air nozzle 53.

EXAMPLE 5

Figure 9:
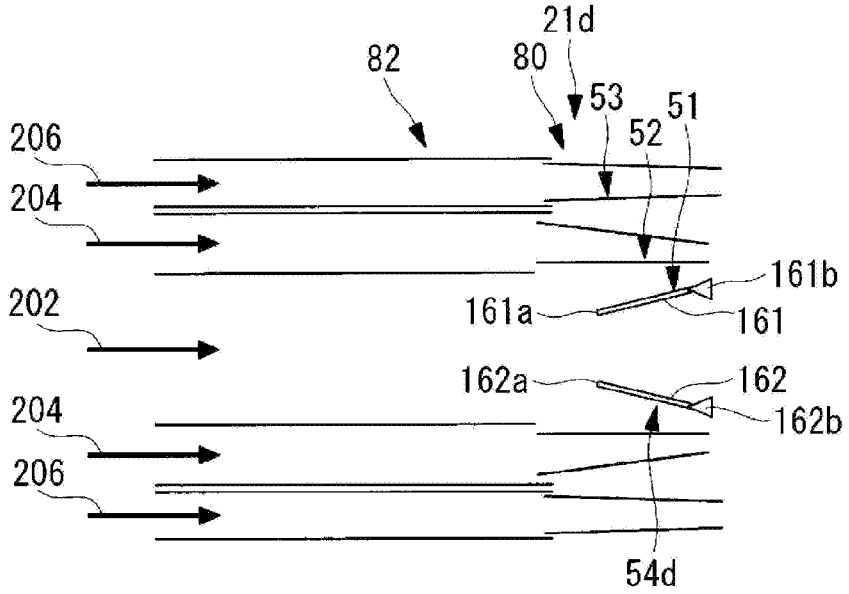
FIG. 9 is a cross-sectional view illustrating a combustion burner according to Example 5 of the present invention.
Figure 10:
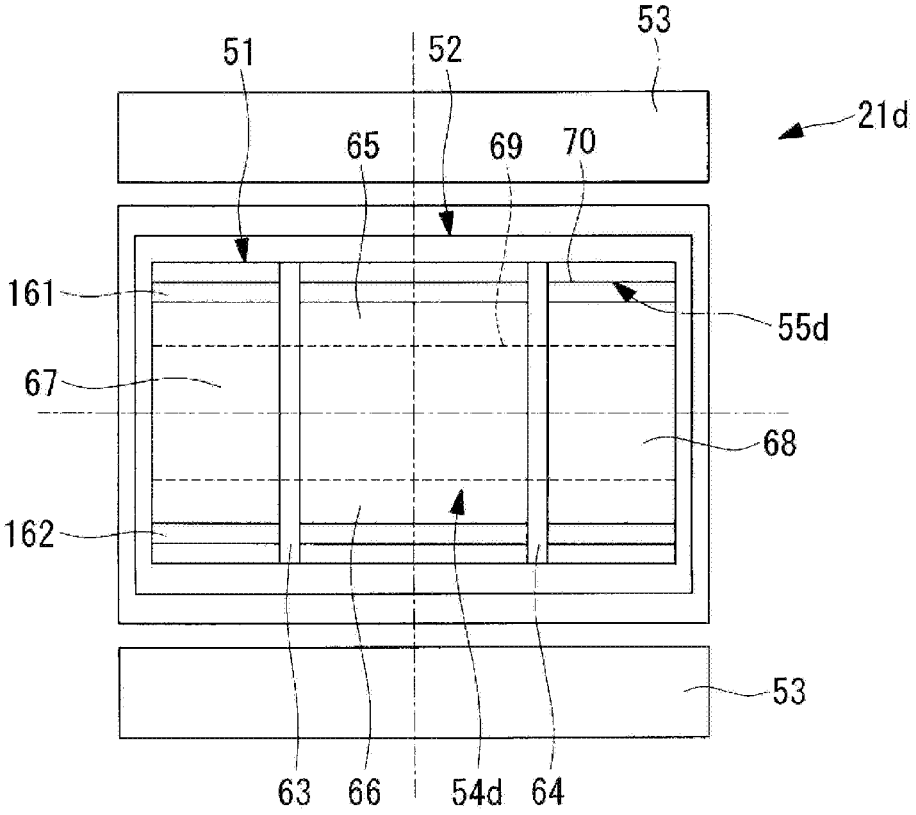
FIG. 10 is a front view of the combustion burner of Example 5.

FIG. 9 is a cross-sectional view illustrating a combustion burner according to Example 5 of the present invention. FIG. 10 is a front view of the combustion burner of Example 5. Note that the same reference numerals are assigned to members having the same functions as the examples described above and a detailed description thereof is omitted. In a combustion burner 21*d* of Example 5 illustrated in FIG. 9, the fuel nozzle 51, combustion burner air nozzle 52, and secondary air nozzle 53 are provided from a center side, and a flame stabilizer 54*d* is provided.

The flame stabilizer 54*d* is inside the fuel nozzle 51, and is provided on an axial center side and on a downstream side in an injecting direction of the fuel gas, and therefore, functions to ignite and stabilize the flame of the fuel gas. The flame stabilizer 54*d* forms a so-called double-cross split structure provided such that first flame stabilizing members 161, 162 along a horizontal direction and second flame stabilizing members 63, 64 along a vertical direction (up and down direction) form a cross shape. Furthermore, the first flame stabilizing members 161, 162 have flat portions 161*a*, 162*a* that form a plate shape with a constant thickness, and widened portions 161*b*, 162*b* integrally provided on a front end portion (downstream end portion in the flow direction of the fuel gas) of the flat portions 161*a*, 162*a*. The widened portions 161*b*, 162*b* have a cross section that forms an isosceles triangle shape, a width that widens when approaching a downstream side in the flow direction of the fuel gas, and a front end that forms a flat surface orthogonal to a flow direction of the fuel gas. Furthermore, the flat portions 161*a*, 162*a* are inclined toward the flow direction of the fuel gas. Specifically, the flat portions 161*a*, 162*a* are inclined in a direction near a wall surface of the combustion burner air nozzle 52, in other words, in a mutually separated direction, when approaching a downstream side in the flow direction of the fuel gas. Thereby, the first flame stabilizing members 161, 162 form a partitioning member that partitions the inner flow channel and outer flow channel. In other words, a flow channel interposed between the first flame stabilizing members 161, 162 is the inner flow channel, and a flow channel between the first flame stabilizing members 161, 162 and combustion burner air nozzle 52 is the outer flow channel.

The second flame stabilizing members 63, 64 have the same shape as the flame stabilizer 54 of Example 1, and the flat portions extend parallel to a flow direction of the fuel gas.

More specifically, the inner flow channel is configured by the flat portions 161*a*, 162*a* and a portion between the flat portions 161*a*, 162 of a side wall surface of the combustion burner air nozzle 52. In other words, a tubular shaped inner flow channel is configured from a portion of the flame stabilizer 54 and a portion of the combustion burner air nozzle 52. For the inner flow channel, the flat portions 161*a*, 162*a* are inclined in a direction approaching the wall surface of the combustion burner air nozzle 52 when approaching a downstream side in the flow direction of the fuel gas, and therefore, the flow channel cross-sectional area of the inner flow channel increases when approaching the downstream side in the flow direction of the fuel gas.

Thereby, the flow channel cross-sectional area of the inner flow channel partitioned by the flat portions 161*a*, 162*a* expand in the flow direction of the fuel gas, and therefore, the same effect as the aforementioned Example 1 and the like can be achieved.

Furthermore, the flame stabilizer 54*d* is not required in a portion of the side wall surface side of the combustion burner air nozzle 52 past the flat portions 161*a*, 162*a* of the widened portions 161*b*, 162*b*. In other words, the flame stabilizer 54*d* might not be provided a widened portion providing flame stabilizing performance in a portion more outside than the casing member 55*d*. Thereby, the possibility of external ignition can be further reduced.

Figure 11:
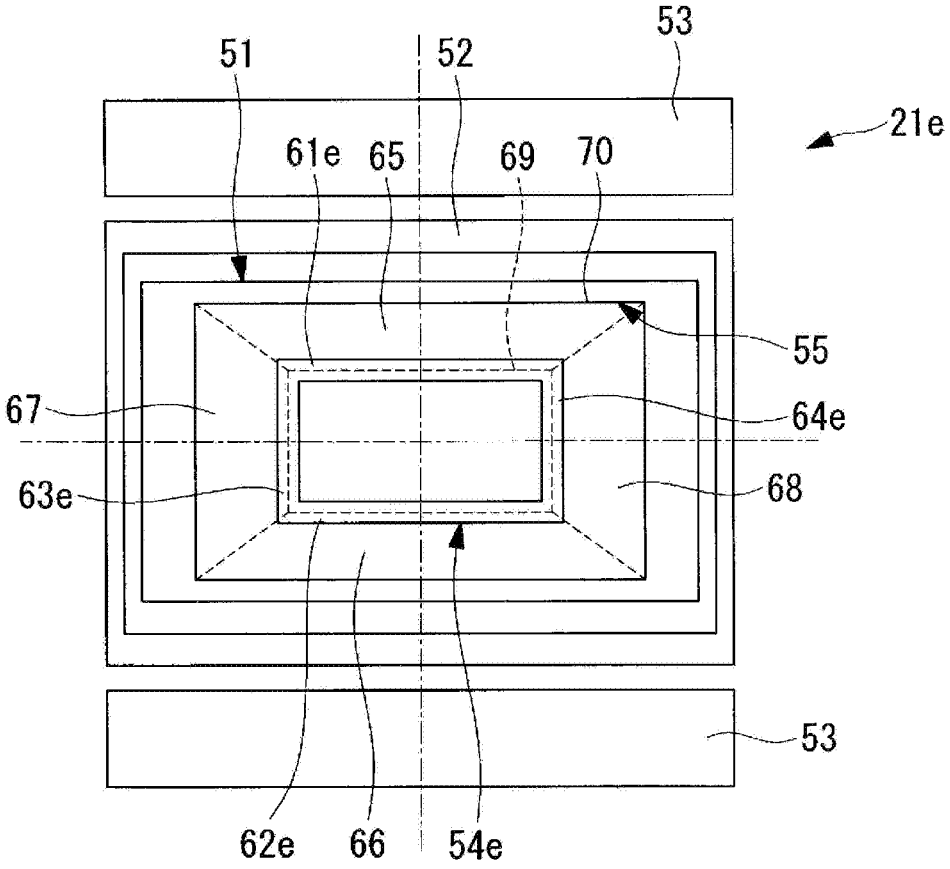
FIG. 11 is a front view of a combustion burner of a modified example.

Herein, the shape of the flame stabilizer of the combustion burner is not limited to the aforementioned shape. FIG. 11 is a front view of a combustion burner of a modified example. In a combustion burner 21*e* illustrated in FIG. 11, the fuel nozzle 51, combustion burner air nozzle 52, and secondary air nozzle 53 are provided from a center side, and a flame stabilizer 54*e* and the casing member 55 are provided.

The flame stabilizer 54*e* is inside the fuel nozzle 51, and is provided on an axial center side and on a downstream side in an injecting direction of the fuel gas, and therefore, functions to ignite and stabilize the flame of the fuel gas. The flame stabilizer 54*e* forms a structure that provides the first flame stabilizing members 61*e*, 62*e* along a horizontal direction, and second flame stabilizing members 63*e*, 64*e* along a vertical direction (up and down direction), where the first flame stabilizing members 61*e*, 62*e* and second flame stabilizing members 63*e*, 64*e* form a square shape. In other words, the first flame stabilizing member 61*e*, 62*e* are not provided between the second flame stabilizing member 63*e* and a side wall surface of the combustion burner air nozzle 52, and between the second flame stabilizing member 64*e* and a side wall surface of the combustion burner air nozzle 52. Furthermore, the second flame stabilizer 63*e*, 64*e* are not provided between the first flame stabilizing member 61*e* and an upper wall surface of the combustion burner air nozzle 52, and between the first flame stabilizing member 62*e* and a lower wall surface of the combustion burner air nozzle 52. The flame stabilizing members 61*e*, 62*e*, 63*e*, 64*e* are the same as the flame stabilizing members 61, 62, 63, 64 of the aforementioned Example 1, except that the provided positions are different. The casing member 55 is provided at a position surrounding a square formed by the flame stabilizing members 61*e*, 62*e*, 63*e*, 64*e*.

The combustion burner 21*e* is a square formed by the flame stabilizing members 61*e*, 62*e*, 63*e*, 64*e* of the flame stabilizer 54*e*, and is not provided at a position contacting the combustion burner air nozzle 52, and therefore, a structure can be formed where the flame stabilizer 54*e* is provided in the casing member 55. Thereby, the flow rate of all of the fuel gas passing through the circumference of the flame stabilizer 54*e* can be reduced.

Furthermore, the flame stabilizer of the present example provided a widened portion with a triangular cross-sectional shape, but is not restricted to this shape, and the shape may be a square shape, or the widened portion may not be provided. Furthermore, in the aforementioned example, the cross-sectional shape of the combustion burner 21 is a square, but the shape may be circular or another polygonal shape.

EXAMPLE 6

Figure 12:
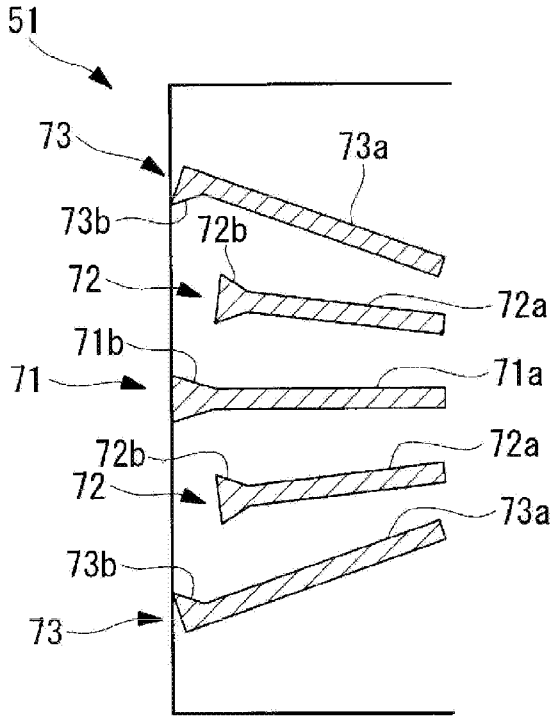
FIG. 12 is a cross-sectional view of a fuel nozzle of a combustion burner according to Example 6 of the present invention in plan view.
Figure 13:
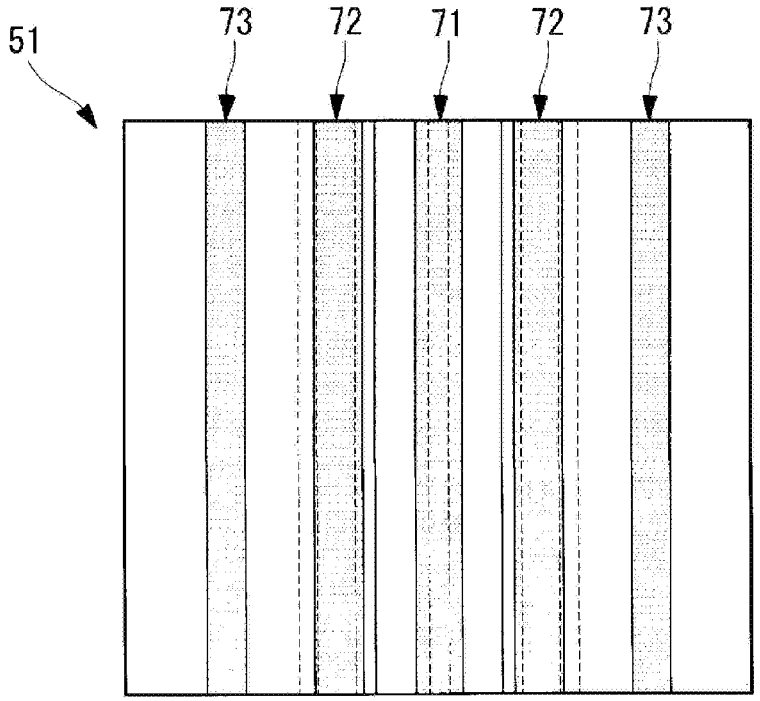
FIG. 13 is a front view of a combustion nozzle of Example 6.

FIG. 12 and FIG. 13 illustrate a combustion nozzle of a combustion burner according to Example 6. The combustion burner of the present example is similar to the aforementioned examples from the perspective that an inner flow channel is formed in which the flow channel cross-sectional area expands in a fuel gas flow direction by a partitioning member. However, the burner is different from the perspective that a plurality of flame stabilizers are provided at different positions in the flow direction of the fuel gas. Note that a description of items similar to the aforementioned examples is omitted.

Furthermore, in FIG. 12 and FIG. 13, the combustion burner air nozzle and secondary air nozzle are omitted, and only the fuel nozzle 51 is illustrated.

The combustion burner of the present example provides: one center flame stabilizing member 71 extending in a vertical direction at a center portion of the fuel nozzle 51; two side portion flame stabilizing members 72 extending in a vertical direction, provided on both sides so as to sandwich the center flame stabilizing member 71; and two partitioning members 73 extending in a vertical direction, provided on both sides so as to sandwich the side flame stabilizing members 72. Thereby, the flame stabilizing members 71, 72 of the present example extend in a vertical direction to form a so-called vertical splitter, without the flame stabilizing members intersecting (crossing) as in the aforementioned examples.

The flame stabilizing member 71 provides a plate-shaped portion 71*a* positioned on an upstream side of a fuel gas flow, and a widened portion 71*b* connected to a downstream end of the plate shape portion 71*a*. Upper and lower ends of the center flame stabilizing member 71 are connected to an inner wall portion of the fuel nozzle 51, in other words, an inner wall portion of the combustion burner air nozzle, as illustrated by FIG. 13. The center flame stabilizing member 71 provided along a fuel gas flow direction, as illustrated in FIG. 12. Note that FIG. 13 illustrates a position of an upstream end of the plate-shaped portion 71*a* by a dotted line.

The two side flame stabilizing members 72 provide a plate-shaped portion 72*a* positioned on an upstream side of a fuel gas flow, and a widened portion 72*b* connected to a downstream end of the plate-shaped portion 72*a*. Upper and lower ends of the side portion flame stabilizing members 72 are connected to an inner wall portion of the fuel nozzle 51, in other words, an inner wall portion of the combustion burner air nozzle, as illustrated by FIG. 13. The side portion flame stabilizing member 72 is provided such that an interval widens between the side portion flame stabilizing members 72 when moving in a fuel gas flow direction, as illustrated in FIG. 12. Note that FIG. 13 illustrates a position of an upstream end of the plate-shaped portion 72*a* by a dotted line.

The two partitioning members 73 provide a plate-shaped portion 73*a* positioned on an upstream side of a fuel gas flow, and a guide surface 73*b* provided on a downstream side of the plate-shaped portion 73*a*. The guide surface 73*b* is inclined so as to guide the fuel gas toward a center side of the fuel nozzle 51, similar to the guide surface 88 illustrated in FIG. 6. Note that in an outer side of a downstream end of the partitioning members 73, a shape is adopted where an outer shape of the plate-shaped portion 73*a* extends in a straight line form to a downstream side, without providing a guide surface protruding to the outside.

Upper and lower ends of the partitioning members 73 are connected to an inner wall portion of the fuel nozzle 51, in other words, an inner wall portion of the combustion burner air nozzle, as illustrated by FIG. 13. The partitioning members 73 is provided such that an interval widens between the partitioning members 73 when moving in a fuel gas flow direction, as illustrated in FIG. 12. Note that FIG. 13 illustrates a position of an upstream end of the plate-shaped portion 73*a* by a dotted line.

A flow channel surrounded by the partitioning members 73 is the inner flow channel, and a flow channel surrounded by the partitioning member 73 and inner wall portion of the fuel nozzle 51, in other words, an inner wall portion forming the combustion burner air nozzle, is the outer flow channel. Therefore, the inner flow channel is formed such that the flow channel cross-sectional area expands in accordance with the fuel gas flow, and therefore, the flow rate of the fuel gas is reduced. The outer flow channel is formed such that the flow channel cross-sectional area is reduced in accordance with the fuel gas flow, and therefore, the flow rate of the fuel gas increases. The functional effect when the fuel gas rate in the inner flow channel is reduced and the functional effect when the fuel gas rate in the outer flow channel is increased are the same as the aforementioned examples, and therefore, a description thereof is omitted.

As illustrated in FIG. 12, a downstream end of the center flame stabilizing member 71 (downstream end of the widened portion 71*b*) and a downstream end of the partitioning members 73 (downstream end of the guide surface 73*b*) are aligned at a position (opening position) of a downstream end of the fuel nozzle 51. On the other hand, the downstream end of the side portion flame stabilizing members 72 (downstream end of the widened portion 72*b*) is positioned on a more upstream side than the downstream end of the center flame stabilizing member 71 and downstream end of the partitioning members 73. In other words, the center flame stabilizing member 71 is a downstream flame stabilizing member, and the side portion flame stabilizing members 72 are upstream flame stabilizing members.

Therefore, the downstream ends of the flame stabilizing members 71, 72 are sorted in a fuel gas flow direction and provided in a stepped manner, and therefore, the flow channel cross-sectional area narrowed by including the widened portions 71*b*, 72*b* positioned on a downstream end of the flame stabilizing members 71, 72 can be reduced as much as possible. Thereby, acceleration of the fuel gas flowing in the inner flow channel can be suppressed, and the flow rate of the fuel gas flowing through the inner flow channel can be brought near the combustion rate to further enhance internal ignition.

Note that in the present example, the downstream end of the center flame stabilizing member 71 and downstream end of the partitioning members 73 are aligned at a position of the downstream end of the fuel nozzle 51, but are not restricted thereto, and may be preferably aligned on a more upstream side than the downstream end of the fuel nozzle 51.

Furthermore, when the flame stabilizing members 71, 72 and partitioning member 73 form a vertical splitter extending in a vertical direction as in the present example, an influence on the flow is less likely to occur, which is advantageous, even if a burner angle adjusting part (for example, refer to reference sign 80 in FIG. 2) that adjusts the angle in a vertical direction is provided.

Note that in the present example, a vertical splitter was described, but a horizontal splitter in which a flame stabilizing member and partitioning member extend in a horizontal direction may be provided with a downstream end of the flame stabilizing member sorted in a fuel gas flow direction as described above.

Figure 14:
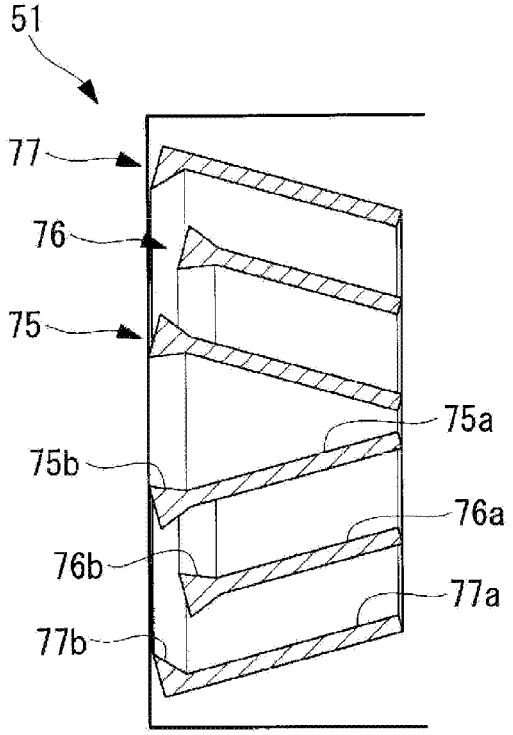
FIG. 14 is a cross-sectional view of a fuel nozzle of a circular combustion burner of a modified example of Example 6 in plan view.
Figure 15:
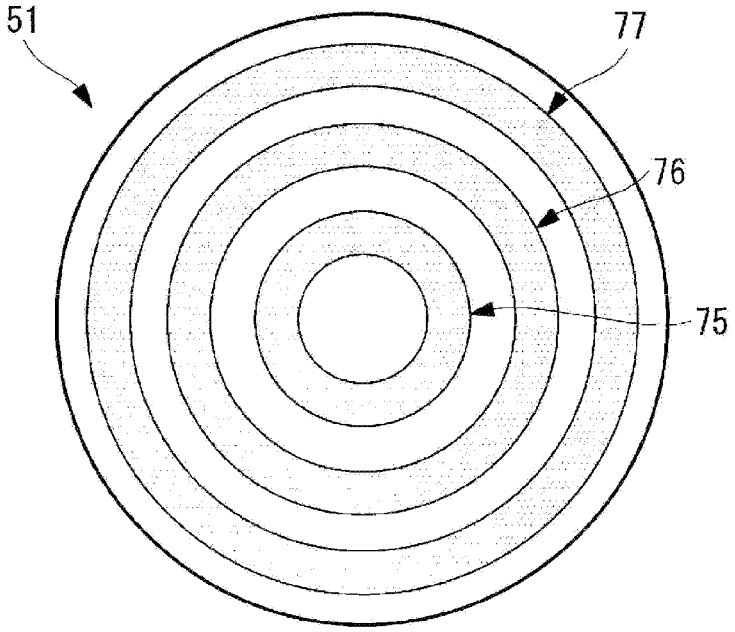
FIG. 15 is a front view of the fuel nozzle in FIG. 14.

Furthermore, in the present example, a combustion burner providing a fuel nozzle having a rectangular horizontal cross section was described, but as illustrated in FIG. 14 and FIG. 15, a circular combustion burner providing a fuel nozzle having a circular horizontal cross section may be provided with a downstream end of a flame stabilizing member is sorted in a fuel gas flow direction as described above.

The circular combustion burner of the present modified example provides: a center circular flame stabilizing member 75 with a conical shape in which the flow channel cross-sectional area widens in a fuel gas flow direction; a side portion circular flame stabilizing member 76 in which the flow channel cross-sectional area widens in a fuel gas flow direction, positioned on an outer circumferential side of the center circular flame stabilizing member 75; and a circular partitioning member 77 in which the flow channel cross-sectional area widens in a fuel gas flow direction, positioned on an outer circumferential side of the side portion circular flame stabilizing member 76. Furthermore, a downstream end of the center circular flame stabilizing member 75 is positioned on a more downstream side than a downstream end of the side portion circular flame stabilizing member 76.

The center circular flame stabilizing member 75 provides a constant thickness portion 75*a* with a constant thickness, positioned on an upstream side of the fuel gas flow, and a widened portion 75*b* connected to a downstream end of the constant thickness portion 75*a*.

The side portion circular flame stabilizing member 76 provides a constant thickness portion 76*a* with a constant thickness, positioned on an upstream side of the fuel gas flow, and a widened portion 76*b* connected to a downstream end of the constant thickness portion 76*a*.

The circular partitioning member 77 provides a constant thickness portion 77*a* with a constant thickness, positioned on an upstream side of the fuel gas flow, and a guide surface 77*b* connected to a downstream end of the constant thickness portion 77*a*. Note that on an outer circumference on a downstream end of the circular partitioning member 77, a shape is adopted where an outer circumferential shape of the constant thickness portion 77*a* extends as is to a downstream side, on a surface protruding to an outer circumferential side.

For this circular combustion burner, the downstream ends of the flame stabilizing members 75, 76 are sorted in a fuel gas flow direction and provided in a stepped manner, and therefore, the flow channel cross-sectional area narrowed by including the widened portion positioned on a downstream end of the flame stabilizing members 75, 76 can be reduced as much as possible.

EXAMPLE 7

Figure 16:
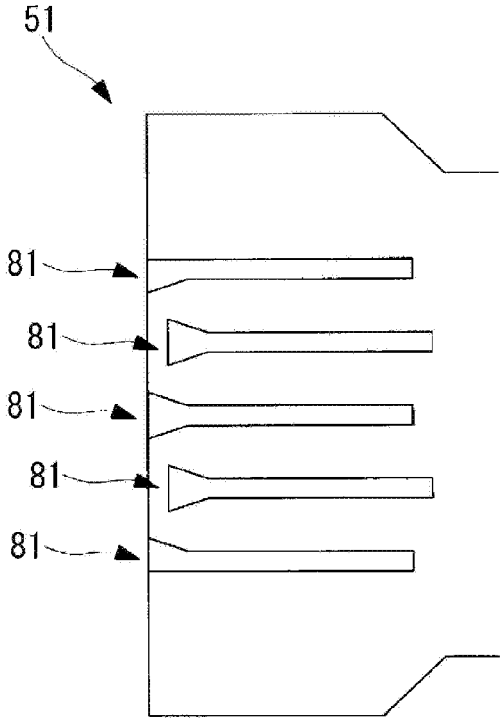
FIG. 16 is a cross-sectional view of a fuel nozzle of Example 7 of the present invention in plan view.
Figure 17:
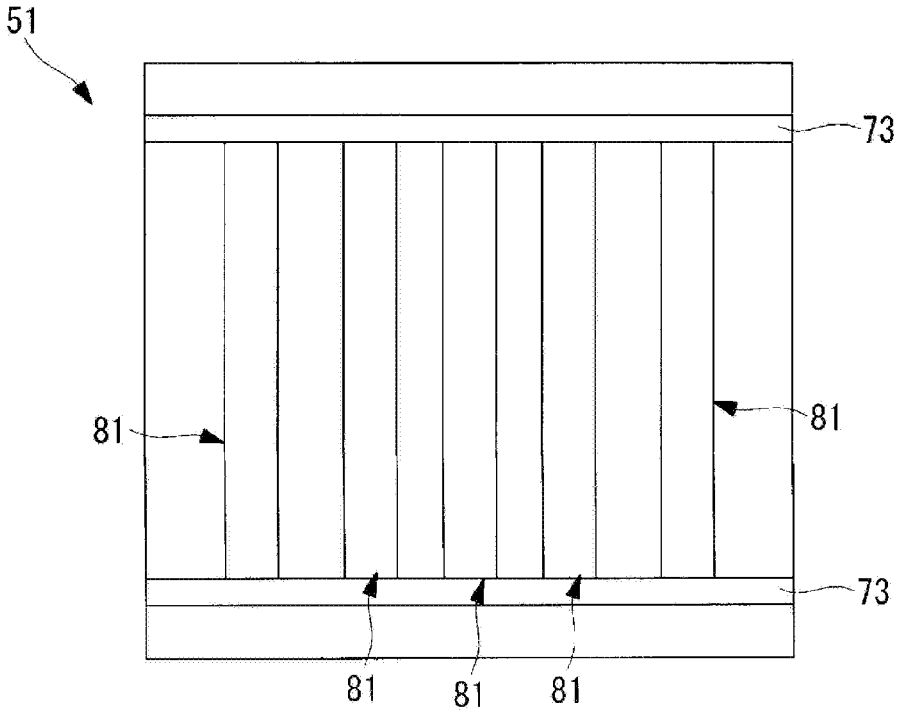
FIG. 17 is a front view of the fuel nozzle in FIG. 16.
Figure 18:
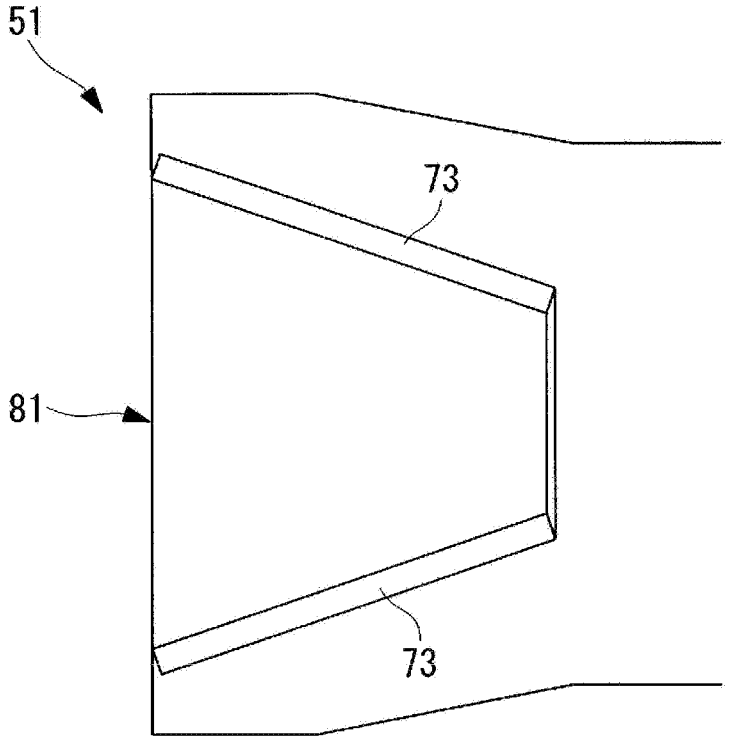
FIG. 18 is a lateral cross-sectional view of the fuel nozzle in FIG. 16.

FIG. 16 to FIG. 18 illustrate a fuel nozzle according to Example 7. The combustion burner of the present example is similar to the aforementioned examples from the perspective that an inner flow channel is formed in which the flow channel cross-sectional area expands in a fuel gas flow direction by a partitioning member. Therefore, a description of items similar to the aforementioned examples is omitted.

Furthermore, in FIG. 16 to FIG. 18, the combustion burner air nozzle and secondary air nozzle are omitted, and only the fuel nozzle 51 is illustrated.

The combustion burner of the present example provides: a plurality (five in the present example) of flame stabilizing members 81 provided at predetermined intervals in a horizontal direction, extending in a vertical direction of the fuel nozzle 51; and two partitioning members 73 extending in a horizontal direction, placed on both ends above and below to sandwich the flame stabilizing members 81. Thereby, the flame stabilizing members 81 of the present example extend in a vertical direction to form a so-called vertical splitter, without the flame stabilizing members intersecting (crossing) as in the aforementioned Example 6. However, unlike Example 6, the flame stabilizing members 81 are provided inclined in a mutually parallel manner, but as illustrated in FIG. 18, an interval between the partitioning members 73 gradually expands towards a downstream side of the fuel gas. In other words, the flow channel cross-sectional area of the inner flow channel partitioned by the partitioning member 73 expands in the flow direction of the fuel gas. Thereby, according the present example, the flow rate of the fuel gas in the inner flow channel can be reduced by the partitioning member 73, and therefore, a more stabilized flame is possible.

Furthermore, in the aforementioned examples, the combustion device 12 had a configuration had four of each combustion burner 21, 22, 23, 24, 25 provided in a vertical direction on a wall surface of the furnace 11 in a 5 stage arrangement, but the device is not limited to this configuration. In other words, the combustion burner may be provided on a corner without providing on a wall surface. Furthermore, the combustion device is not limited to a swirling combustion system, and may be a front combustion system in which a combustion burner is provided on one wall surface, or an opposing combustion system in which combustion burners are opposingly provided on two wall surfaces.

REFERENCE SIGNS LIST

10 Pulverized coal burning boiler
11 Furnace
21, 22, 23, 24, 25 Combustion burner
51 Fuel nozzle
52 Combustion burner air nozzle
53 Secondary air nozzle
54 Flame stabilizer
55 Casing member
61, 62, 63, 64 Flame stabilizing member
65, 66, 67, 68 Plate member
69, 70 Opening
71 Center flame stabilizing member
72 Side portion flame stabilizing member
73 Partitioning member
80 Burner angle adjusting part
82 Pipe line portion
102, 104 Guide member

The invention claimed is:

1. A combustion burner, comprising:

a fuel nozzle that injects fuel gas in which fuel and air are mixed;

at least one flame stabilizer provided on an axial center side near a tip end of the fuel nozzle; and a partitioning member that partitions an inner flow channel in which the flame stabilizer is provided and an outer flow channel on an outer side of the inner flow channel, inside the fuel nozzle; wherein the flow channel cross-sectional area of the inner flow channel partitioned by the partitioning member expands in a flow direction of the fuel gas.

2. The combustion burner according to claim 1, wherein the partitioning member is a casing member.

3. The combustion burner according to claim 1, wherein the partitioning member has two plate-shaped bodies that extend mutually providing an interval with the flame stabilizer interposed therebetween, and the plate-shaped bodies are connected to a wall surface demarcating an outer circumference of the fuel nozzle.

4. The combustion burner according to claim 1, comprising: a combustion burner air nozzle supplying air from the outside of the fuel nozzle, wherein the flow channel cross-sectional area of the outer flow channel partitioned by the partitioning member decreases in the flow direction of the fuel gas.

5. The combustion burner according to claim 1, wherein the partitioning member has an inclination angle, which is an angle to a direction parallel to a flow direction of the fuel gas, that decreases with regard to an upstream end portion in the flow direction of the fuel gas, when approaching a tip end side.

6. The combustion burner according to claim 1, wherein a guide surface inclined toward an axial center side of the fuel nozzle is provided on an inner wall surface of the partitioning member, based on moving in the flow direction of the fuel gas.

7. The combustion burner according to claim 1, comprising: a combustion burner air nozzle supplying air from the outside of the fuel nozzle, wherein the combustion burner air nozzle has an area of a surface surrounded by an outer surface that decreases with regard to an upstream end portion in the flow direction of the fuel gas, when approaching the tip end.

8. The combustion burner according to claim 1, further comprising a guide member provided on a more upstream side than the partitioning member, that guides the fuel gas flowing inside the fuel nozzle to an axial center side.

9. The combustion burner according to claim 1, comprising:

a combustion burner air nozzle supplying air from the outside of the fuel nozzle, further comprising a secondary air nozzle that injects air from the outside of the combustion burner air nozzle; wherein the secondary air nozzle has a surface on an axial center side with an inclination separated from the axial center based on moving toward a tip end side, and air flowing inside the secondary air nozzle is discharged in a direction guided to the axial outside, isolated from air injected by the secondary air nozzle.

10. The combustion burner according to claim 1, wherein the flame stabilizer forms a structure where two parallel first flame stabilizing members that extend along a horizontal direction and have a predetermined gap in a vertical direction, and two parallel second flame stabilizers that extend along a vertical direction and that have a predetermined gap in a horizontal direction are provided so as to intersect.

11. The combustion burner according to claim 1, the flame stabilizer, comprising:

an upstream side flame stabilizing member provided on an upstream side of a fuel gas flow; and a downstream side flame stabilizing member provided on a downstream side of the fuel gas with regard to the upstream side flame stabilizing member.

12. The combustion burner according to claim 1, wherein the flame stabilizer has a widened portion on a downstream side in the flow direction of the fuel gas.

13. A boiler, comprising:

a furnace;

the combustion burner according to claim 1 installed with regard to the furnace; and a heat exchanger that exchanges heat with combustion gas from the combustion burner at a downstream side of the furnace.

* * * * *